US007836732B1

(12) United States Patent
Chen et al.

(10) Patent No.: US 7,836,732 B1
(45) Date of Patent: Nov. 23, 2010

(54) METHOD AND APPARATUS FOR LOWERING AND FOLDING FABRIC AT AMOUNT SAME AS FABRIC KNITTED AND UNLOADED BY A CIRCULAR KNITTING MACHINE

(75) Inventors: Shih-Chi Chen, Taipei Hsien (TW); Jenq-Huey Shyu, Taipei (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 12/613,904

(22) Filed: Nov. 6, 2009

(51) Int. Cl.
*D04B 35/10* (2006.01)

(52) U.S. Cl. ..... 66/151

(58) Field of Classification Search ..... 66/147, 66/151, 152, 153
See application file for complete search history.

(56) References Cited

U.S. PATENT DOCUMENTS 1,289,811 A * 12/1918 Killian ..... 66/153
1,450,799 A * 4/1923 Fisher ..... 66/153
2,561,491 A * 7/1951 Brooks ..... 66/153
3,521,466 A * 7/1970 Tannert ..... 66/19
5,381,676 A * 1/1995 Shibata et al. ..... 66/149 R
5,960,647 A * 10/1999 Fan ..... 66/151
6,016,670 A * 1/2000 Kuhrau et al. ..... 66/152
6,023,949 A * 2/2000 Lonati et al. ..... 66/153
6,952,939 B2 * 10/2005 Lonati et al. ..... 66/153

* cited by examiner

*Primary Examiner*—Danny Worrell
(74) *Attorney, Agent, or Firm*—Muncy, Geissler, Olds & Lowe, PLLC

(57) ABSTRACT

A method and apparatus for lowering and folding fabric at the same amount knitted and unloaded by a circular knitting machine delivers a fabric continuously knitted by the circular knitting machine and temporarily holds and in a buffer transient storing apparatus which divides the fabric into three zone fabric lengths and delivers later Through the buffer transient storing apparatus the three zone fabric lengths can complement with each other mechanically so that the fabric above the reciprocal moving of the forward and reverse turning fabric folding bars can be maintained at a constant tension, and the fabric knitted continuously by the circular knitting machine can be lowered at an equal amount and folded on a fabric loading board.

16 Claims, 16 Drawing Sheets

METHOD AND APPARATUS FOR LOWERING AND FOLDING FABRIC AT AMOUNT SAME AS FABRIC KNITTED AND UNLOADED BY A CIRCULAR KNITTING MACHINE

FIELD OF THE INVENTION

The present invention relates to a method and apparatus to lower and fold fabric continuously and particularly to a method and apparatus to mechanically lower and fold fabric concurrently at the same amount knitted by a circular knitting machine.

BACKGROUND OF THE INVENTION

Conventional fabric folding machines adopted for use with circular knitting machines now on the market can be divided into half-width fabric folding machines and full-width fabric folding machines according to the fabric folding width. On a full-width fabric folding machine, the fabric folding machine is located in a circular knitting machine which continuously knits and produce fabric, the fabric folding machine concurrently folds the lowering fabric at a maximum width. On the other hand a half-width fabric folding machine folds the fabric at a width one half of the full-width fabric folding machine.

The half-width fabric folding machine has drawbacks in use. After the fabric is knitted by the circular knitting machine, it has to be treated in a dyeing process. A dyeing tank usually can hold a fixed amount of fabric in the dyeing process. The fabric has a head and a tail that are connected to reach the fixed amount of quantity before being loaded into the dyeing tank to do dyeing process. Due to the half-width fabric folding machine provides a batch of fabric only one half of the full-width fabric folding machine, after the dyeing process is finished the head and tail portions of the fabric that are not evenly dyed have to be cut off. This results in a greater amount of waste. Reducing the waste can reduce the material cost. Hence the main stream of the market of the fabric folding machine for circular knitting machines is the full-width fabric folding machine that can fold the fabric at the maximum full-width.

However, the conventional full-width fabric folding machine still has its share of problems. Refer to FIGS. 1A and 1B for the conventional fabric folding machine in operating conditions. As shown in FIG. 1A, when a circular knitting machine continuously knits a fabric 7, if the fabric 7 does not sag naturally below a fabric spreading roller set 2 and above a fabric folding bar set 5, the fabric below the fabric folding bar set 5 increases gradually at the same amount knitted continuously by the circular knitting machine. If the driving wheel 3 rotates continuously clockwise to drive a chain 4 to move the fabric folding bar set 5 horizontally rightwards, the fabric folding bar set 5 flatly spreads the increased fabric 7 beneath thereof on a fabric loading board 6 same as the mount knitted by the circular knitting machine. If the driving wheel 3 continuously rotates clockwise to drive the conveying chain 4 to move the fabric folding bar set 5 horizontally rightwards, the fabric folding bar set 5 can flatly spread the increased fabric beneath thereof same as that knitted continuously by the circular knitting machine on the fabric loading board 6. However, after the fabric folding bar set 5 has moved horizontally rightwards, the fabric 7 below the fabric spreading roller set 2 and above the fabric folding bar set 5 has two problematic conditions, first the fabric folding bar set 5 has to be incorporated with an automatic faster fabric conveying means (such as a programmable controlled motor to generate faster rotation) to deliver the fabric faster below the fabric folding bar set 5. But such an approach often creates another problem as shown in FIG. 1B in which the fabric 7 laid on the fabric spreading board is creased. On the other hand, if the fabric folding bar set 5 does not automatically convey the fabric faster, the fabric originally hung below the fabric spreading roller set 2 and above the fabric folding bar set 5 sags as shown in FIG. 1B. When the fabric folding bar set 5 moves horizontally the sagged fabric hinders its movement and could cause machine jam. To overcome the problems shown in FIG. 1B, a preferable approach is to move the fabric folding bar set 5 rapidly beneath the fabric spreading roller set 2 where the fabric 7 is delivered before it is knitted by the circular knitting machine, and the fabric 7 which is originally located below the fabric spreading roller set 2 and above the fabric folding bar set 5 also has to be conveyed at the same time beneath the fabric folding bar set 5 to be flatly spread on the fabric loading board 6. Then machine jam can be prevented when the fabric folding bar set 5 moves horizontally. While the aforesaid approach seems advisable in principle, in practice no physical technique is yet available to move the fabric folding bar set 5 rapidly beneath the fabric 7 delivered by the fabric spreading roller set 2 before the circular knitting machine actually knits the fabric 7.

In short, the conventional half-width and full-width fabric folding machines still have problems in practice, notably:

1. The half-width fabric folding machine provides fabric only one half of the full-width fabric folding machine. After the dyeing process the head and tail ends of the fabric 7 have to be cut off that creates a lot of scraps. Waste of manpower and material occurs.

2. The conventional full-width fabric folding machine cannot flatly spread the fabric without generating creases during the return movement of fabric folding. The creases are difficult to flatten after being compressed by the weight of the fabric laid on the upper side.

3. During the return movement of fabric folding of the conventional full-width fabric folding machine the fabric above the fabric folding bar set 5 easily sags before lowering and folding due to inadequate tension of the transverse fabric 7. This hinders the horizontal return path of the fabric folding bar set 5 and could cause machine jam.

All the problems mentioned above related to the half-width and full-width fabric folding machines are still existed in the industry pending to be resolved.

SUMMARY OF THE INVENTION

The primary object of the present invention is to solve the aforesaid problems of the conventional half-width and full-width fabric folding machines and the fabric folding methods thereof by providing a method and apparatus to increase tension to maintain flat of the transverse fabric before fabric lowering and move the transverse fabric mechanically in a repetitive transient storing and feeding approach so that the fabric is lowered and folded in full-width at an amount same as knitted and unloaded by a circular knitting machine.

To achieve the foregoing object the present invention provides a method and apparatus to lower and fold fabric at an amount same as knitted and unloaded by a circular knitting machine. The method includes: providing a fabric spreading roller set in a circular knitting machine below fabric knitted continuously by the circular knitting machine that rotates synchronously with a needle cylinder of the circular knitting machine in the same direction and has spinning power to move the fabric downwards; winding the fabric knitted continuously by the circular knitting machine through the fabric spreading roller set to flatten the fabric and winding out from the fabric spreading roller set at one side; providing two horizontal fabric folding rails below the fabric spreading roller set perpendicular thereof that have respectively a horizontal track; providing a first fabric extending bar at the fabric winding out side of the fabric spreading roller set that is hinged on an outer side of the track in a straddle manner in parallel with the fabric spreading roller set; winding the fabric delivered from the fabric spreading roller set on the first fabric extending bar which winds out the fabric at a lower side in a direction opposite to the winding in direction; providing a tension balance moving bar on the track in a straddle manner at the fabric winding out side of the first fabric extending bar that is parallel with the fabric spreading roller set and movable horizontally and reciprocally on the track; winding the fabric released from the first fabric extending bar on the tension balance moving bar and winding out the fabric at a lower side thereof opposite to the winding in direction so that the first fabric extending bar and the tension balance moving bar are spaced from each other at a distance of a first zone fabric length; providing a first chain holding spot fastened to another outer side of track of the fabric folding rail at one side same as the fabric winding out side of the first fabric extending bar; providing a chain with one end held on the first chain holding spot and another end winding on a side end of the tension balance moving bar and winding out at a lower side in a direction opposite to the winding in direction so that the first chain holding spot and the tension balance moving bar are spaced from each other to form a first zone chain length; providing a second fabric extending bar at the fabric winding out side of the tension balance moving bar that is hinged on the outer side of the track in a straddle manner parallel with the fabric spreading roller set; winding the fabric released from the tension balance moving bar on the second fabric extending bar and winding out the fabric at a lower side opposite to the winding in direction so that the tension balance moving bar and the second fabric extending bar are spaced from each other at a second zone fabric length; providing a chain turning axle hinged on the outer side of the track at the chain winding out side of the tension balance moving bar; winding the chain released from the tension balance moving bar on the chain turning axle and winding out at a lower side opposite to the winding in direction so that the tension balance moving bar and the chain turning axle are spaced from each other at a second zone chain length; providing a fabric level moving and lowering means on the track that is movable reciprocally and horizontally and hinged by a forward turning fabric folding bar and a reverse turning fabric folding bar in a straddle manner that are parallel with each other and parallel with the fabric spreading roller set and movable reciprocally and horizontally on the fabric folding rails between the second fabric extending bar and the chain turning axle and have spinning power; winding the fabric released from the second fabric extending bar between the forward turning fabric folding bar and the reverse turning fabric folding bar and lowering the fabric below and between the forward turning fabric folding bar and the reverse turning fabric folding bar at an amount same as the continuously knitted amount of the circular knitting machine and the second fabric extending bar being spaced from the interval of the forward turning fabric folding bar and the reverse turning fabric folding bar to form a third zone fabric length; providing a second chain holding spot on the fabric level moving and lowering means; fastening the chain winding out from the chain turning axle to the second chain holding spot so that the chain turning axle and the second chain holding spot are spaced from each other at a third zone chain length; providing a fabric loading board in the circular knitting machine below the fabric level moving and lowering means at a width at least same as the fabric width and at a length at least same as the reciprocal moving distance of the forward turning fabric folding bar and the reverse turning fabric folding bar while the fabric level moving and lowering means is moving horizontally and reciprocally, and the fabric loading board and the fabric spreading roller set rotating synchronously in the same direction; moving the fabric level moving and lowering means horizontally and reciprocally between the second fabric extending bar and the chain turning axle while the fabric is delivered and lowered below the interval of the forward turning fabric folding bar and the reverse turning fabric folding bar at the same amount knitted continuously by the circular knitting machine, the fabric decreasing an amount at the third zone fabric length equal to the sum of fabric increasing amount of the first zone fabric length and the second zone fabric length, and the fabric increasing same amount at the first zone fabric length and at the second zone fabric length, and the fabric decreasing an amount at the third zone fabric length equal to an increasing amount of the third zone chain length, and also equal to the sum decreasing amount of the first and second zones chain length; on the other hand, the fabric also increasing an amount at the third zone fabric length equal to the sum of fabric decreasing amount of the first zone fabric length and the second zone fabric length, and the fabric decreasing same amount at the first zone fabric length and the second zone fabric length, and the fabric increasing an amount at the third zone fabric length equal to a decreasing amount of the third zone chain length, and also equal to the sum of increasing amount of the first and second zones chain length; moving the tension balance moving bar and the fabric level moving and lowering means reciprocally and horizontally between the tracks concurrently opposite to each other such that the fabric above the fabric level moving and lowering means maintains a constant tension while moving reciprocally and horizontally and the an equal amount of the fabric is lowered and folded on the fabric loading board.

The invention also provides a buffer transient storing apparatus in the foregoing method. The buffer transient storing apparatus has a transmission link with a variable direction and variable speed wheel box driven by spinning power of a needle cylinder of the circular knitting machine. The variable direction and variable speed wheel box has two ends directing upwards to pivotally couple with the fabric spreading roller set to provide the spinning power so that the fabric spreading roller set is rotated synchronously with the needle cylinder in the same direction. The fabric spreading roller set is located horizontally in the circular knitting machine below the fabric knitted by the circular knitting machine. The variable direction and variable speed wheel box has a fabric loading board fastened thereon. The buffer transient storing apparatus includes: two corresponding fabric folding rails fastened to a lower side of two ends of the fabric spreading roller set hinged on an upper extension of the variable direction and variable speed wheel box and located horizontally in the circular knitting machine above the fabric loading board perpendicular to the fabric spreading roller set and having respectively a horizontal track corresponding to each other, a first fabric extending bar parallel with the fabric spreading roller set with two ends hinged on an outer side of the two tracks, a tension balance moving bar movable reciprocally and horizontally on the tracks parallel with the fabric spreading roller set and with two ends straddled the tracks, a second fabric extending bar parallel with the fabric spreading roller set with two ends hinged on another outer side of the two tracks at the same side of the first fabric extending bar, two first chain holding spots fastened to other outer sides of the tracks, two chain turning axles hinged on the outer side of the tracks same as the first chain holding spots, two fabric level moving and lowering means located on the twp fabric folding rails movable reciprocally and horizontally between the second fabric extending bar and the chain turning axles, and a forward turning fabric folding bar and a reverse turning fabric folding bar that are hinged on the fabric level moving and lowering means in a straddle manner parallel with each other horizontally and also parallel with the fabric spreading roller set and having spinning power. The two fabric level moving and lowering means have respectively a second chain holding spot, two chains each having one end fastened to the first chain holding spot and another end winding about a side end of the tension balance moving bar and the chain turning axle in a reverse manner to fasten to the two second chain holding spots.

The invention further provides a full-width fabric folding machine adopted the aforesaid buffer transient storing apparatus. The full-width fabric folding machine includes a variable direction and variable speed wheel box driven by spinning power of a needle cylinder of a circular knitting machine. The variable direction and variable speed wheel box is located at the bottom of the circular knitting machine to rotate synchronously with the needle cylinder in the same direction, and has two ends with a first side board and a second side board located thereon directing upwards to be bridged by a fabric loading board. The full-width fabric folding machine further has a fabric spreading roller set hinged on the first and second side boards below the fabric knitted by the circular knitting machine and above the fabric loading board to form a transmission link with the variable direction and variable speed wheel box, a driving means hinged on the second side board to form a transmission link with the fabric spreading roller set, and a buffer transient storing apparatus located between the fabric spreading roller set and the fabric loading board. The buffer transient storing apparatus has two fabric folding rails fastened to the first and second side boards. The driving means forms a transmission link with the fabric level moving and lowering means located on the fabric folding rails on the second side board.

Compared to the methods and techniques of lowering and folding fabric adopted by the conventional half-width and full-width fabric folding machines, the foregoing method provided by the invention has many advantages, notably:

1. The invention is a full-width fabric folding machine with maximum fabric holding capacity, and produces minimum scraps after fabric dyeing compared with the half-width fabric folding machine. Hence it can reduce labor and material costs.

2. The full-width fabric folding machine of the invention can move the transverse fabric repeatedly for transient storing and delivering and also maintain flat tension for the transverse fabric during the fabric folding return cycle. Thus the amount of the fabric being lowered is same as knitted and unloaded by the circular knitting machine. The fabric being lowered is flat and the problem of machine jam can be prevented. As a result, the circular knitting machine has improved knitting efficiency.

3. The full-width fabric folding machine of the invention performs fabric lowering at the same amount as the fabric unloading from the circular knitting machine through a mechanical approach without relying on programmable controllers. Thus its production cost is lower and earth resource waste also can be reduced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1A:
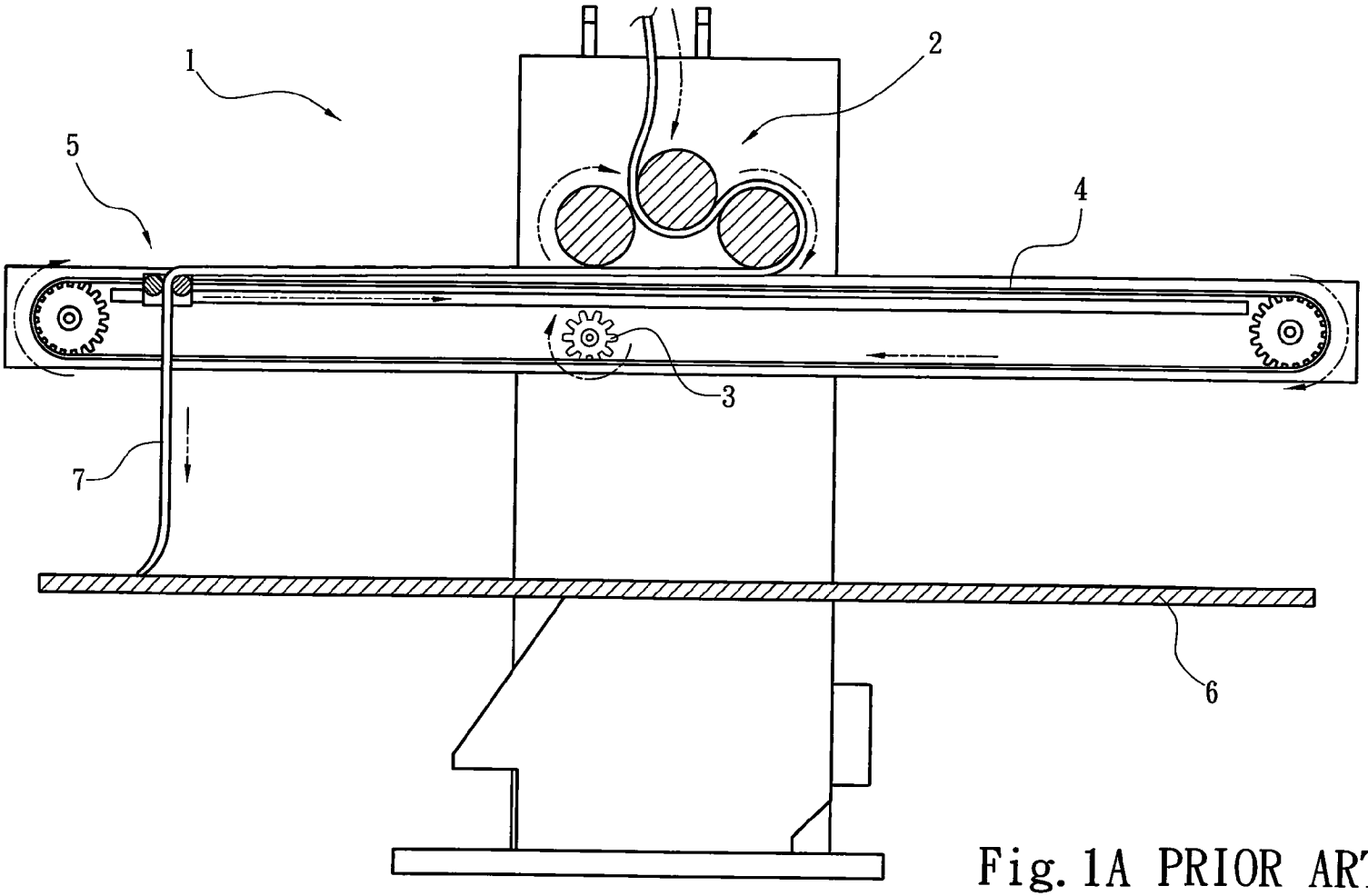
Fig. 1A PRIOR ART
FIGS. 1A and 1B are plane views of a conventional full-width fabric folding machine in fabric folding operations.
Figure 1B:
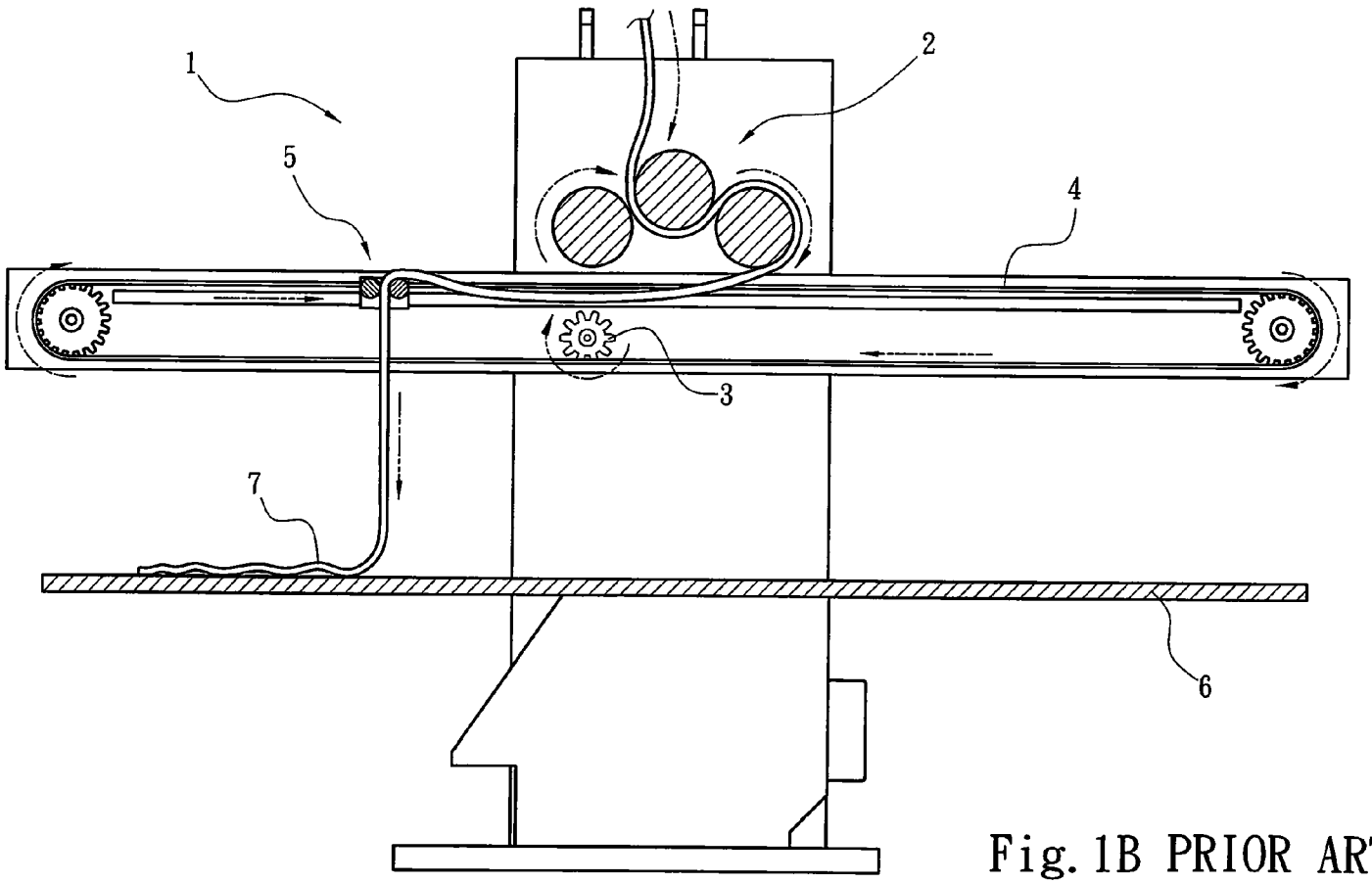
Fig. 1B PRIOR ART
Figure 2:
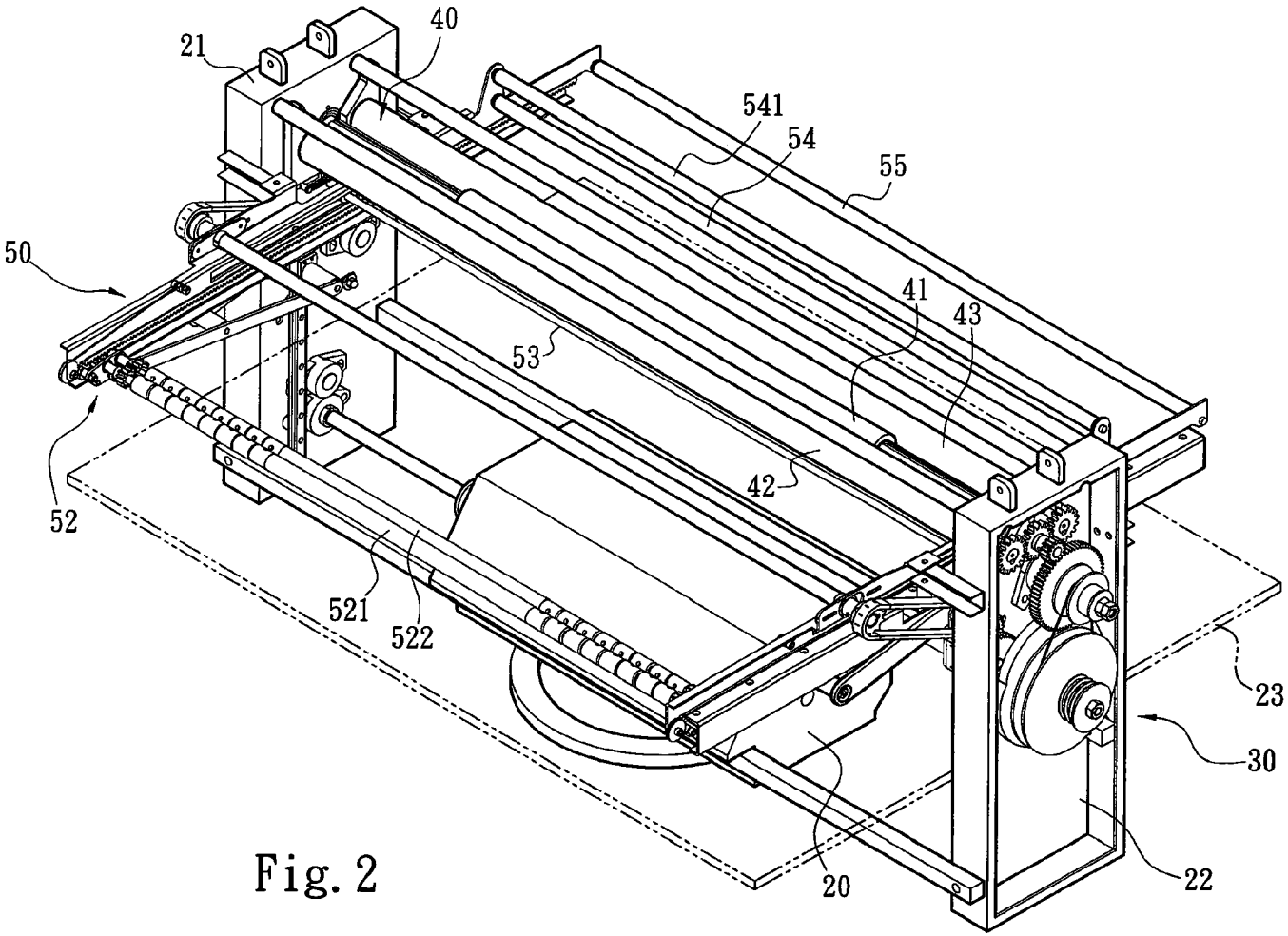
FIG. 2 is a perspective view of the full-width fabric folding machine of the invention.
Figure 3:
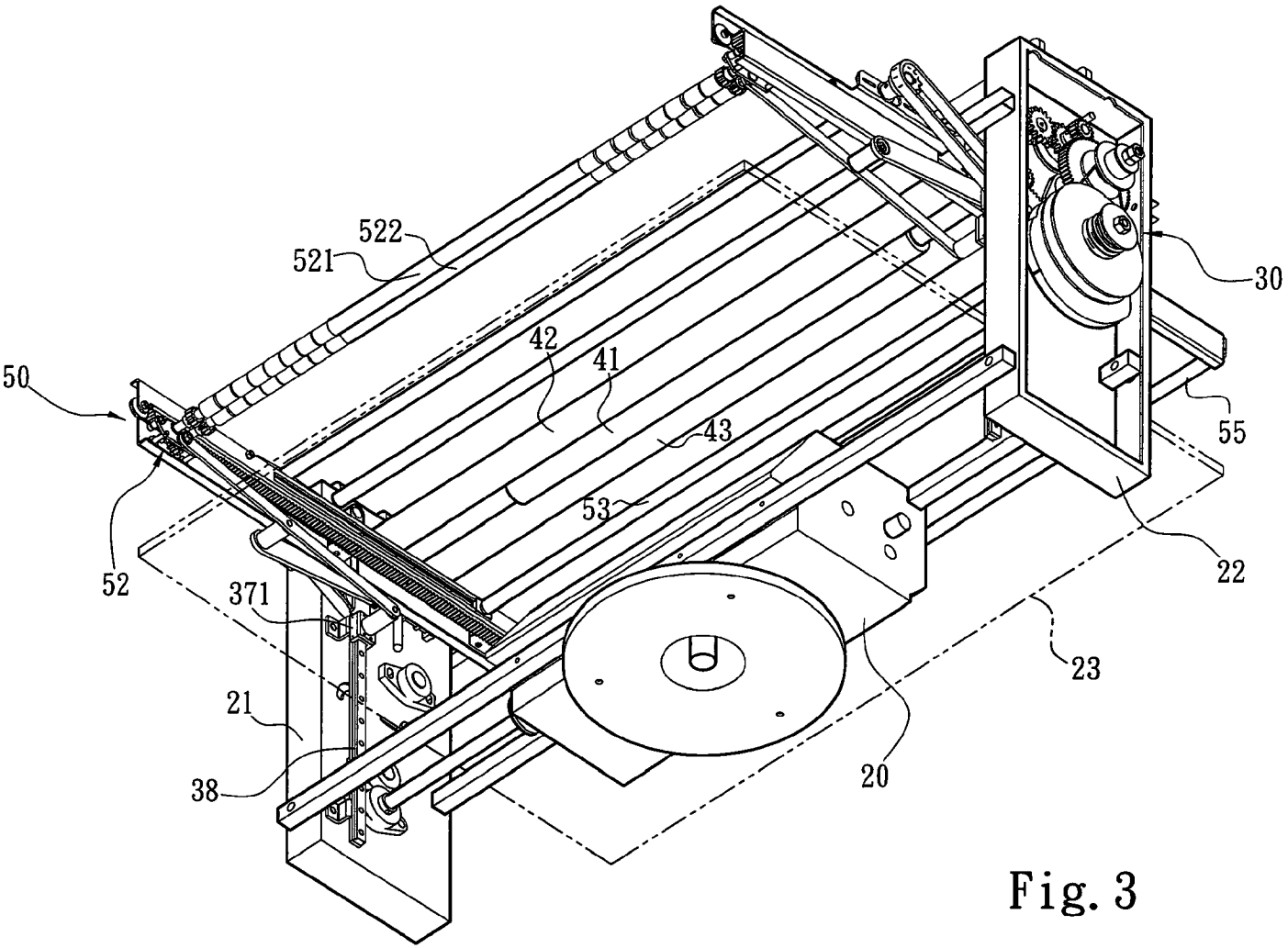
FIG. 3 is another perspective view of the full-width fabric folding machine of the invention according to FIG. 2 viewing from the bottom.
Figure 4:
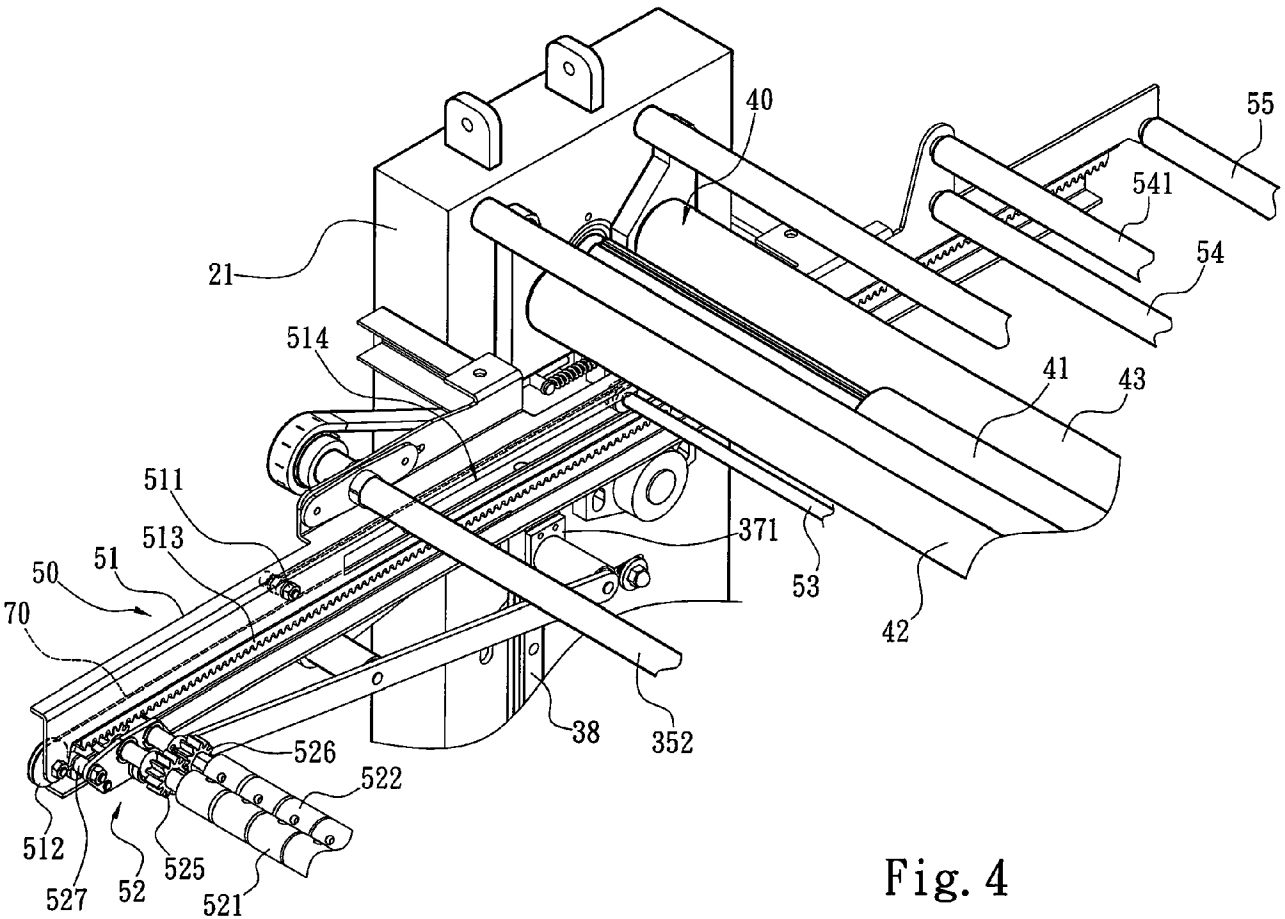
FIG. 4 is a fragmentary enlarged view according to FIG. 2.

Please referring to FIGS. 2, 3 and 4, the present invention provides a full-width fabric folding machine 10 which is located at the bottom in the interior of a circular knitting machine and rotates synchronously with a needle cylinder of the circular knitting machine in the same direction, and has a variable direction and variable speed wheel box 20 driven by the spinning power of the needle cylinder through a transmission link. The variable direction and variable speed wheel box 20 has a first side board 21 and a second side board 22 extended upwards from two ends thereof. The first and second side boards 21 and 22 are bridged by a fabric loading board 23 above the variable direction and variable speed wheel box 20. The two side boards 21 and 22 also are horizontally hinged between them by two ends of a fabric spreading roller set 40 below a fabric 60 knitted by the circular knitting machine and above the fabric loading board 23. Also referring to FIG. 7, the fabric spreading roller set 40 includes a main fabric spreading roller 41, a first driven roller 42 at one side of the main fabric spreading roller 41 rotating synchronously in a reverse direction against the main fabric spreading roller 41 and a second driven roller 43 at another side of the main fabric spreading roller 41 rotating synchronously in the reverse direction against the main fabric spreading roller 41. The main fabric spreading roller 41 is driven by the spinning power of the variable direction and variable speed wheel box 20 through another transmission link.

The full-width fabric folding machine 10 of the invention further has a buffer transient storing apparatus 50 located between the fabric spreading roller set 40 and the fabric loading board 23. Also referring to FIGS. 4, 5A and 6, the buffer transient storing apparatus 50 includes two corresponding fabric folding rails 51 which are fixedly fastened to the first and second side boards 21 and 22 extended upwards from the variable direction and variable speed wheel box 20, and below two ends of the fabric spreading roller set 40 and above the fabric loading board 23 in a horizontal manner and perpendicular to the fabric spreading roller set 40. The two fabric folding rails 51 have respectively a horizontal track 514 corresponding to each other, a first fabric extending bar 54 parallel with the fabric spreading roller set 40 with two ends hinged on an outer side of the two tracks 514, a tension balance moving bar 53 movable reciprocally and horizontally on the tracks 514 in parallel with the fabric spreading roller set 40 with two ends straddling the tracks 514, a second fabric extending bar 55 parallel with the fabric spreading roller set 40 with two ends hinged on the outer side of the two tracks 514 same as the first fabric extending bar 54, two first chain holding spots 511 fastened to another outer side of the tracks 514, two chain turning axles 512 corresponding to each other and hinged on the outer side of the tracks 514 same as the first chain holding spot 511, two fabric level moving and lowering means 52 located on the two fabric folding rails 51 and movable reciprocally and horizontally between the second fabric extending bar 55 and the chain turning axles 512, and a forward turning fabric folding bar 521 and a reverse turning fabric folding bar 522 that are hinged in a straddle manner on the fabric level moving and lowering means 52 parallel with each other horizontally and equipped with spinning power. The forward turning fabric folding bar 521 and reverse turning fabric folding bar 522 are parallel with the fabric spreading roller set 40. The two fabric level moving and lowering means 52 further have respectively a second chain holding spot 527, two chains 70 each having one end fastened to the first chain holding spot 511 and another end winding about a side end of the tension balance moving bar 53 and the chain turning axle 512 in a reverse manner to fasten to the two second chain holding spots 527. Each of the two fabric folding rails 51 further has a gear rack 513 fastened to an upper side of the track 514. The gear rack 513 is formed at a length less that the interval of the second fabric extending bar 55 and the chain turning axle 512. The forward turning fabric folding bar 521 has two ends fastened respectively to a first one-way gear 523 and a forward turning gear 525. The reverse turning fabric folding bar 522 also has two ends fastened respectively to a second one-way gear 524 and a reverse turning gear 526. The first and second one-way gears 523 and 524 are at one end of the forward and reverse turning fabric folding bars 521 and 522 of the same side to engage with the gear rack 513 at the same side, and the forward turning gear 525 and reverse turning gear 526 at the other end are engaged with each other.

Figure 8:
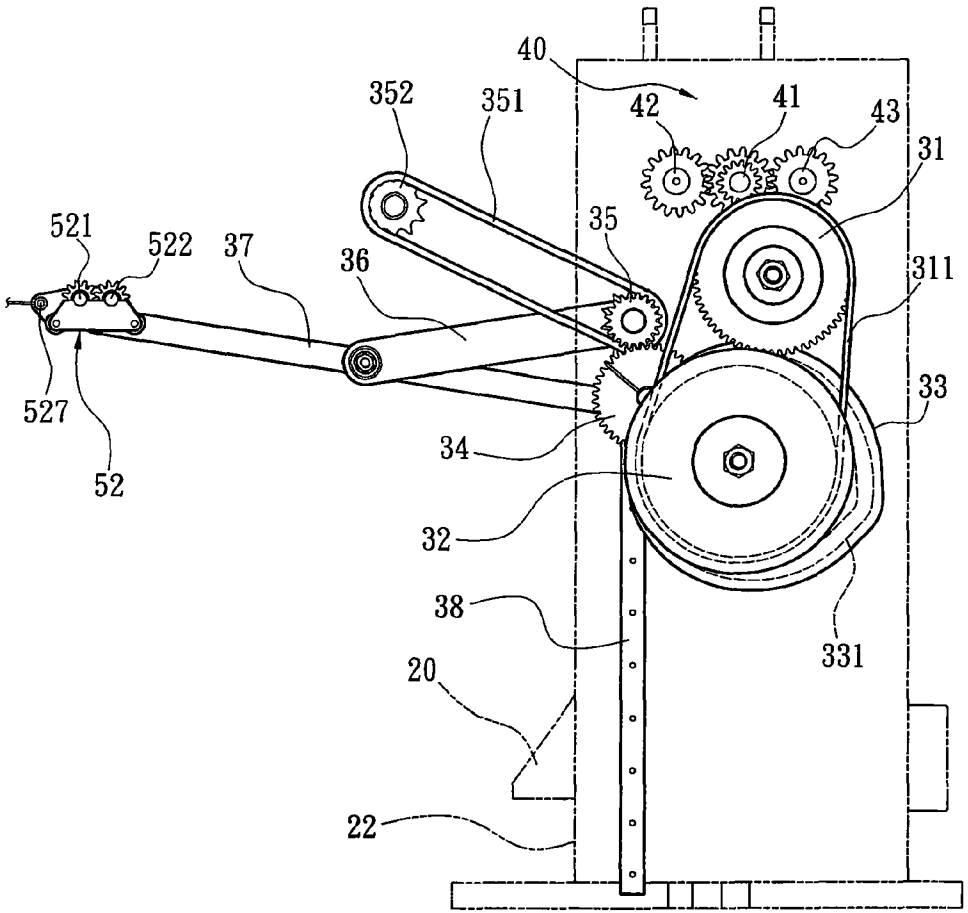
FIG. 8 is a plane view of the driving means of the invention in a transmission link condition.
Figure 9A:
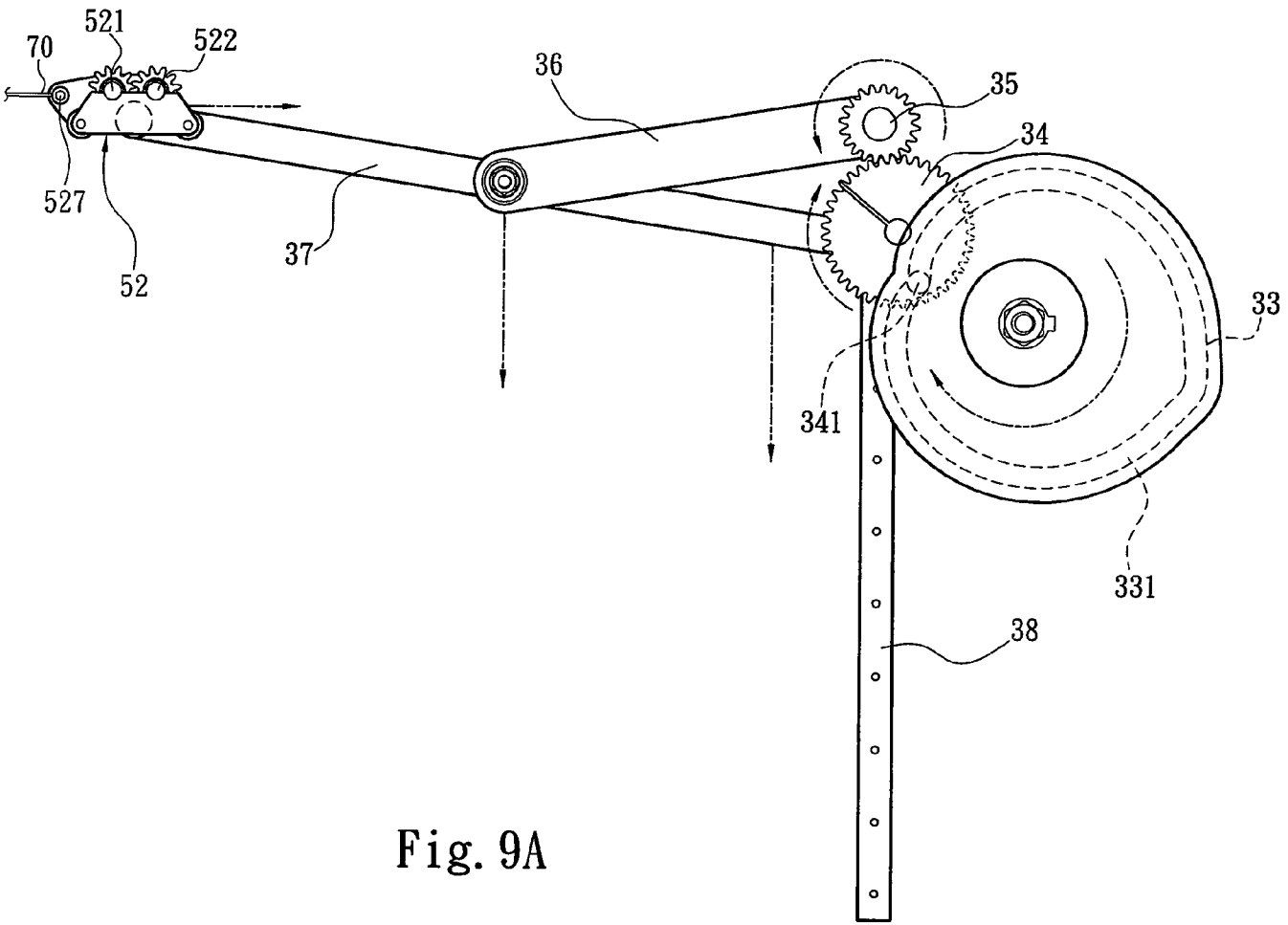
FIGS. 9A through 9E are fragmentary schematic views of the driving means according to FIG. 8 in consecutive operating conditions.
Figure 9B:
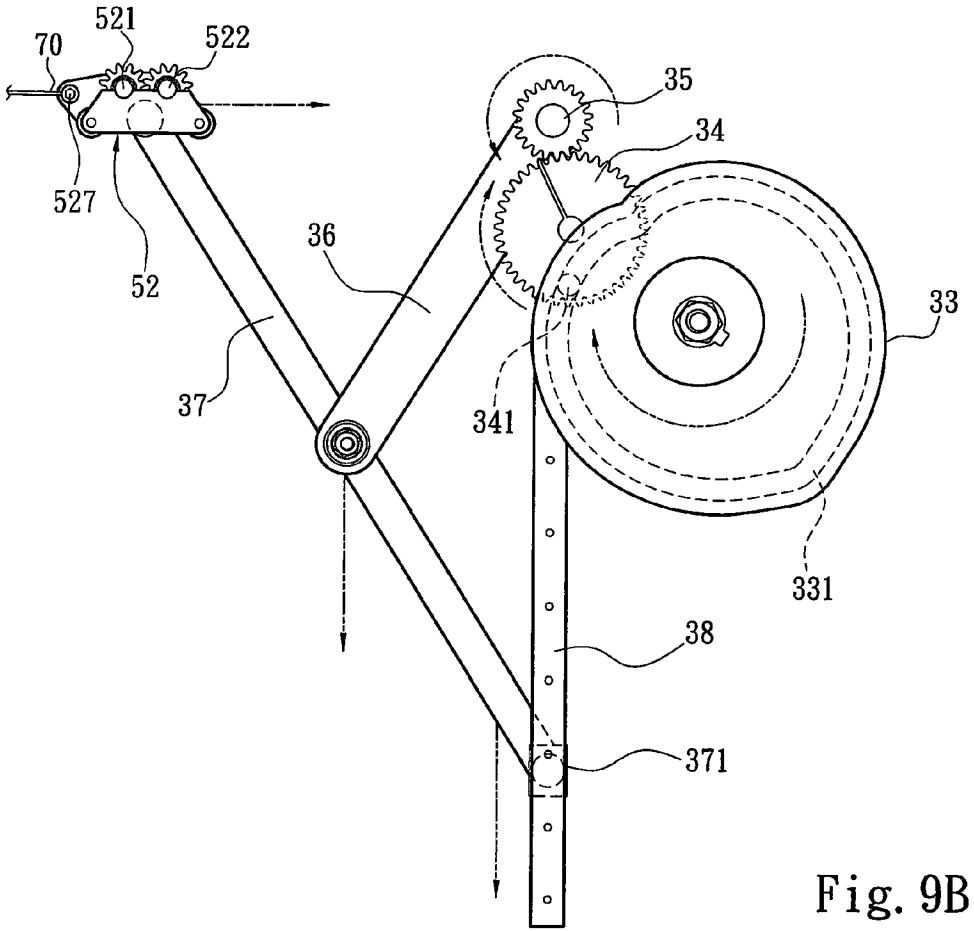

The full-width fabric folding machine 10 of the invention further has a driving means 30 hinged on the second side board 22 to form a transmission link with the fabric spreading roller set 40. Referring to FIGS. 8 and 9B, the driving means 30 includes a cam driving wheel 31 hinged on the second side board 22 and engaged with the main fabric spreading roller 41 to transmit rotation synchronously in the reverse direction, and a cam driven wheel 32 hinged on the outer side of the second side board 22 to form a transmission link with the cam driving wheel 31 to rotate synchronously in the same direction. The cam driving wheel 31 and the cam driven wheel 32 are coupled through a linking chain 311 to form the transmission link. The linking chain 311 may be a belt, chain or gears. The driving means 30 further has a cam 33 hinged on the outer side of the second side board 22 and fastened to the cam driven wheel 32 to rotate synchronously in the same direction. The cam 33 has a cam track 331 consisting of two symmetrical and indented arched paths. There is also an actuation wheel 34 hinged on the outer side of the second board 22 with an actuation member 341 fastened thereon and held in a protrusive manner in the cam track 331 and movable along the path of the cam track 331 to swing the actuation wheel 34 in an oscillation manner. There is also a transmission wheel 35 hinged on the outer side of the second board 22 to form a transmission link with the actuation wheel 34 to swing thereof synchronously in the reverse direction. There is further an oscillation arm 36 with one end located at an inner side of the second side board 22 to fasten to the transmission wheel 35 and another end hinged on a triple-axis lever 37. The triple-axis lever 37 has one end hinged on the fabric level moving and lowering means 52 and another end hinged on a slider 371 at the inner side of the second side board 22. There is a slide track 38 to allow the slider 371 to slide on a straight line. The slide track 38 is vertically located on the inner side of the second side board 22. The transmission wheel 35 is connected to a transmission shaft 352 to transmit movement concurrently in the same direction. The transmission wheel 35 and the transmission shaft 352 are bridged by a transmission linking chain 351 to link transmission therebetween. The transmission linking chain 351 may be a belt, a chain or gears. The transmission shaft 352 can transmit movement concurrently in the same direction to the fabric level moving and lowering means 52 located on the first side board 21.

When the fabric level moving and lowering means 52 is moved the forward turning fabric folding bar 512 and the reverse turning fabric folding bar 522 rotate continuously and synchronously in opposite directions. To further elaborate such operation, referring to FIGS. 4 and 6, as previously discussed, the gear rack 513 is fastened to the upper side of the track 514. The forward turning fabric folding bar 521 has the two ends fastened respectively to the first one-way gear 523 and the forward turning gear 525. The reverse turning fabric folding bar 522 also has the two ends fastened respectively to the second one-way gear 524 and the reverse turning gear 526. The first and second one-way gears 523 and 524 are coupled respectively with a one-way bearing with a shaft driven by forces of different directions to rotate (such a technique is known in the art, thus detailed drawings and discussion are omitted herein). Hence the first one-way gear 523 and the second one-way gear 524 at the same side of the forward and reverse turning fabric folding bars 521 and 522 are positioned in a front and rear manner to engage with the gear rack 513. Thus when the fabric level moving and lowering means 52 is moved rightwards the one-way bearing shaft coupled with the first one-way gear 523 is not driven and idled, while the another one-way bearing shaft coupled with the second one-way gear 524 is driven. Hence the second one-way gear 524 is engaged with the gear rack 513 to generate rotation to drive the reverse turning fabric folding bar 522 to rotate concurrently counterclockwise, while the first one-way gear 523 is engaged with the gear rack 513 but not engaged with the second one-way gear 524, hence even though the first one-way gear 523 rotates counterclockwise due to the gear rack 513, its one-way bearing shaft is not being driven and becomes idled so that the forward turning fabric folding bar 521 fastened to the one-way bearing shaft also is not driven and is idled. However, because the forward turning fabric folding bar 521 and the reverse turning fabric folding bar 522 still have the forward turning gear 525 and reverse turning gear 526 engaged on the same side, when the reverse turning fabric folding bar 522 rotates counterclockwise the reverse turning gear 526 also rotates concurrently counterclockwise, and the engaged forward turning gear 525 is driven to rotate concurrently clockwise to drive the forward turning fabric folding bar 521 to rotate concurrently clockwise. On the other hand, when the fabric level moving and lowering means 52 is moved leftwards the another one-way bearing shaft coupled with the second one-way gear 524 is not driven and is idled, while the one-way bearing shaft coupled with the first one-way gear 523 is driven. Hence the first one-way gear 523 is engaged with the gear rack 513 to generate rotation to drive the forward turning fabric folding bar 521 to rotate concurrently clockwise, while the second one-way gear 524 is engaged with the gear rack 513 but not engaged with the first one-way gear 523, hence even though the second one-way gear 524 rotates clockwise due to the gear rack 513, its one-way bearing shaft is not being driven and becomes idled so that the reverse turning fabric folding bar 522 fastened to the one-way bearing shaft also is not driven and is idled. However, because the forward turning fabric folding bar 521 and the reverse turning fabric folding bar 522 still have the forward turning gear 525 and reverse turning gear 526 engaged on the same side, when the forward turning fabric folding bar 521 rotates clockwise the forward turning gear 525 also rotates concurrently clockwise, and the engaged reverse turning gear 526 is driven to rotate concurrently counterclockwise to drive the reverse turning fabric folding bar 522 to rotate concurrently counterclockwise.

Figure 5A:
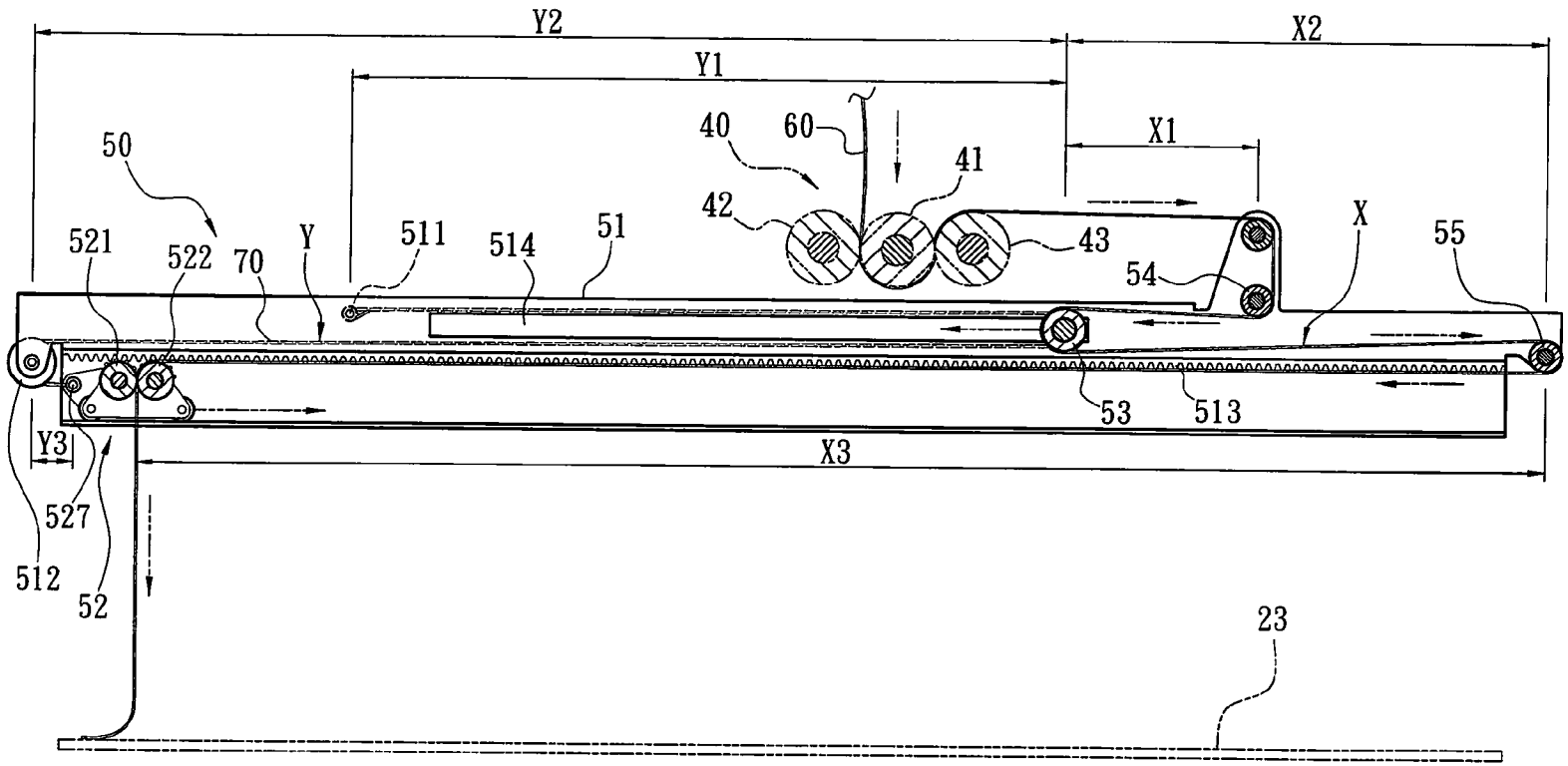
FIGS. 5A through 5D are schematic views of the buffer transient storing apparatus of the invention in consecutive operating conditions.
Figure 5B:
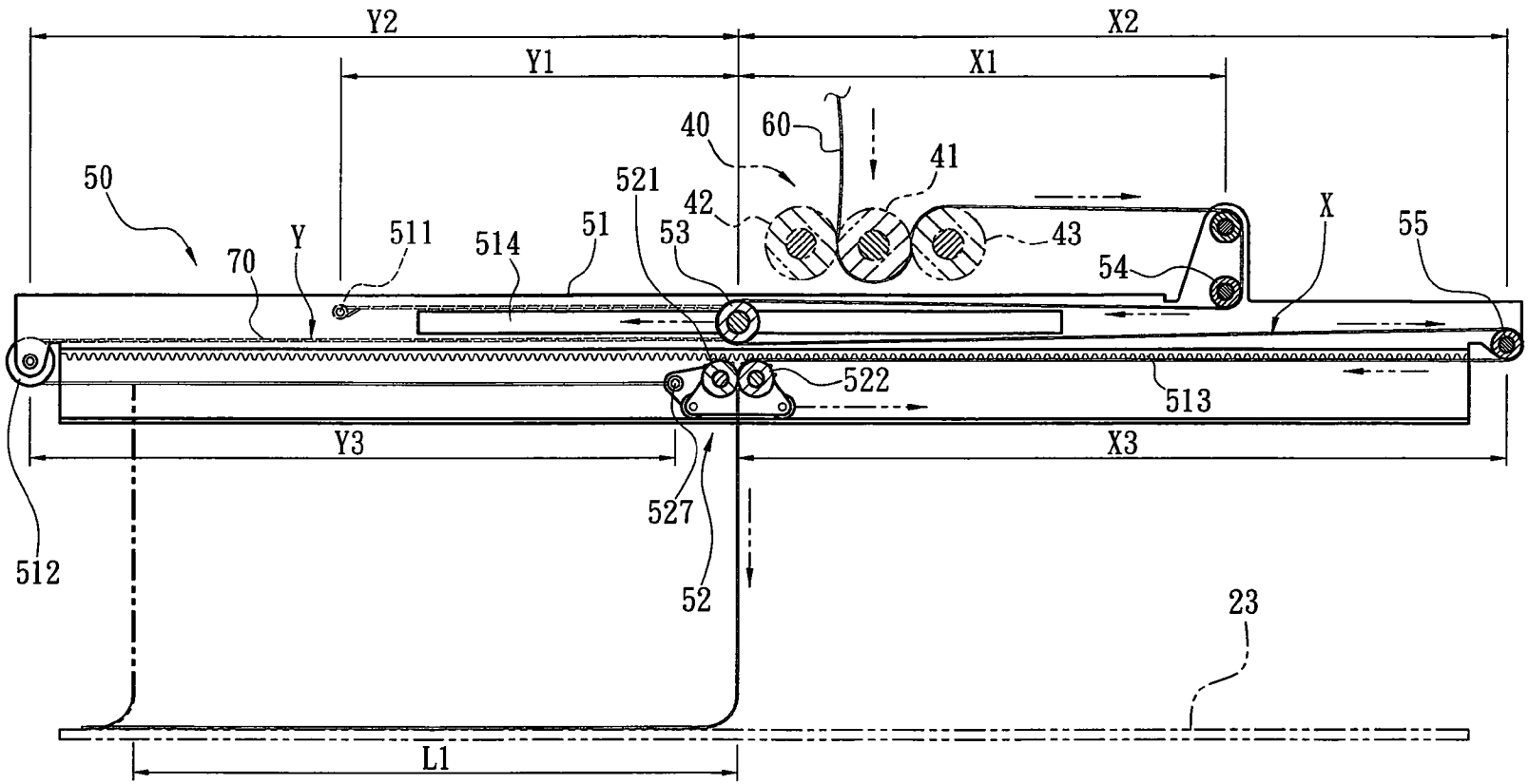
Figure 5C:
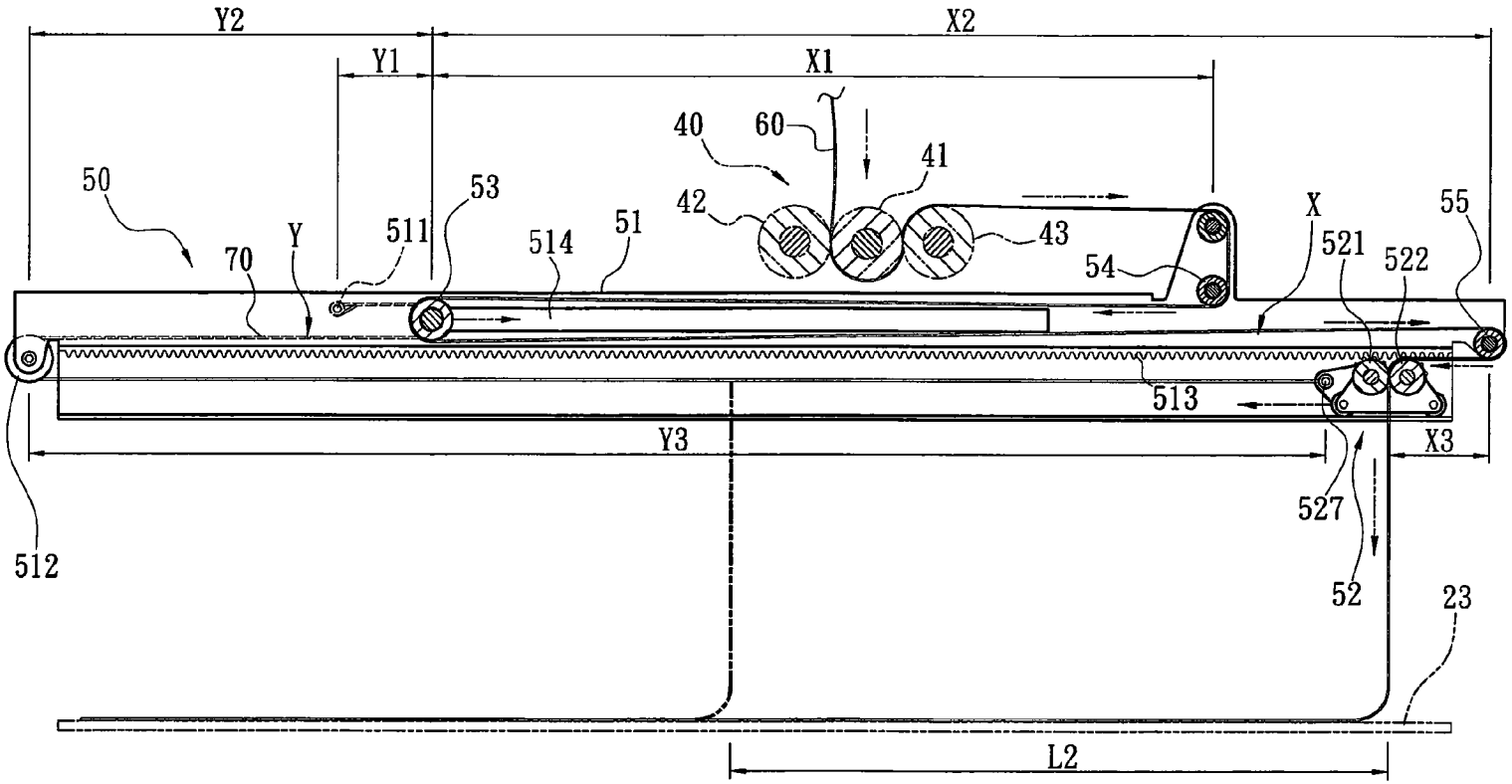
Figure 5D:
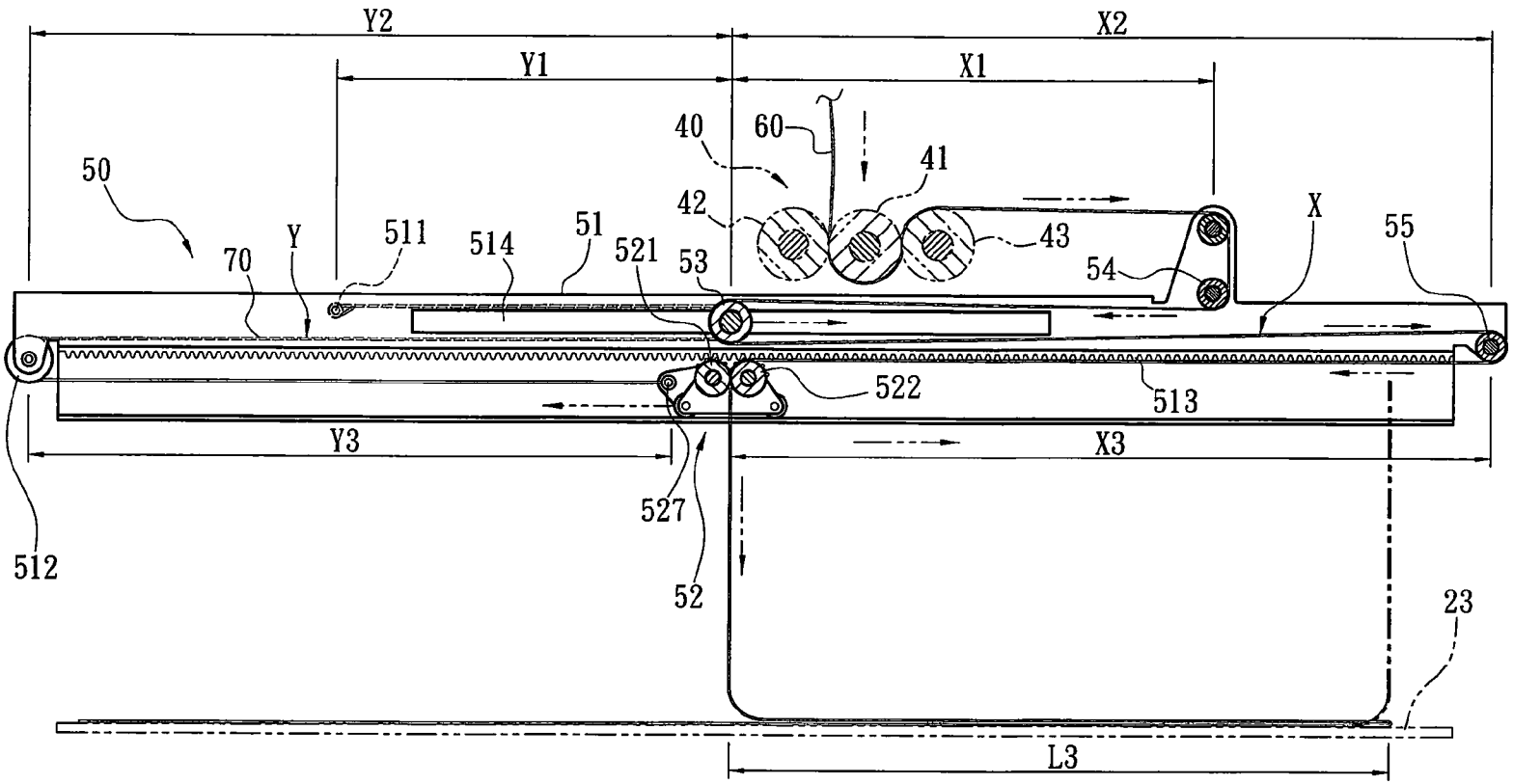
Figure 6:
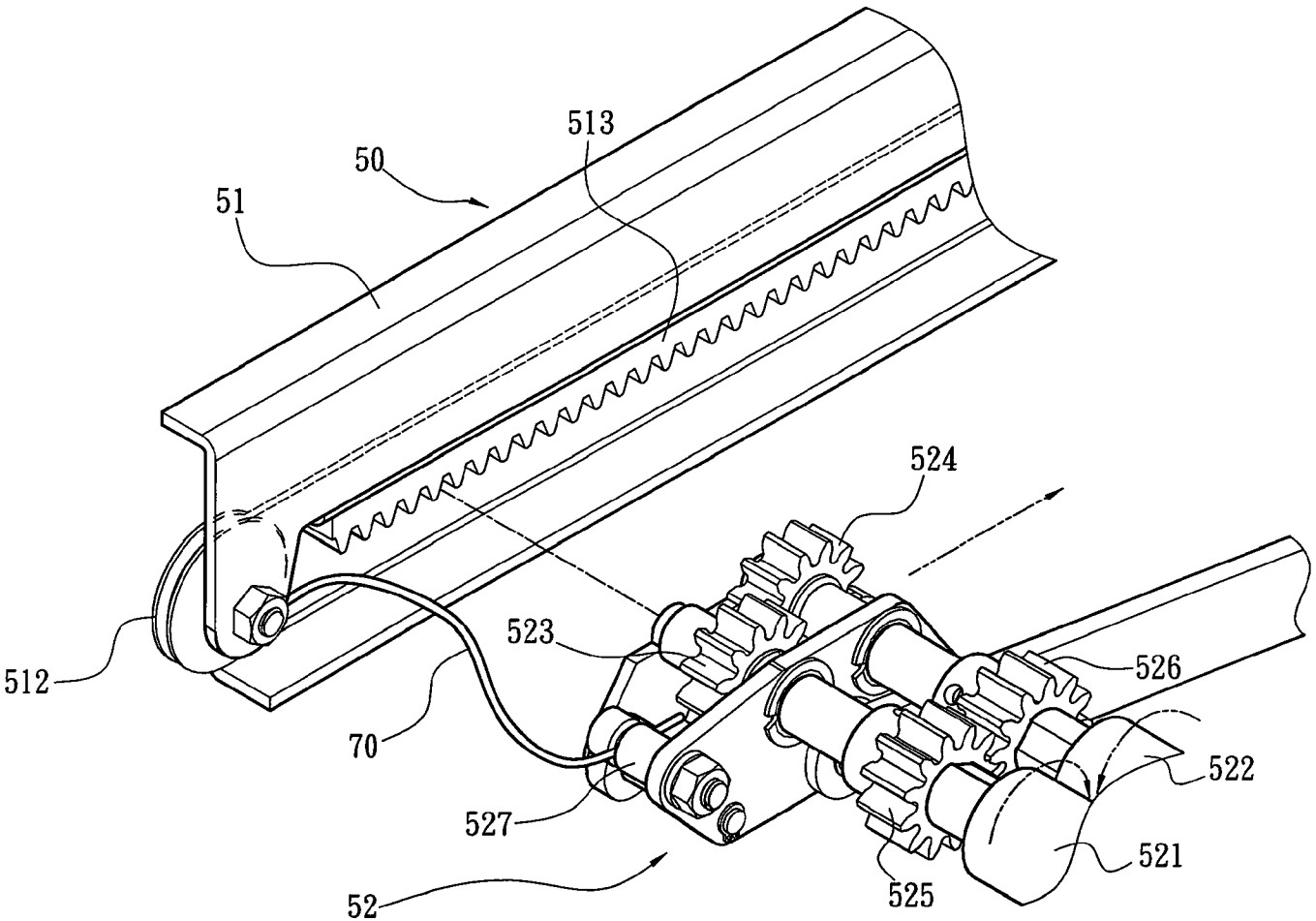
FIG. 6 is a fragmentary exploded view of the fabric level moving and lowering means according to FIG. 4.

Refer to FIGS. 5A through 5D for the buffer transient storing apparatus of the invention in consecutive operating conditions. The fabric spreading roller set 40 is horizontally located below the fabric 60 knitted by the circular knitting machine. The fabric spreading roller set 40 has a main fabric spreading roller 41, a first driven roller 42 at one side of the main fabric spreading roller 41 to be driven to rotate concurrently in the opposite direction and a second driven roller 43 at another side of the main fabric spreading roller 41 to be driven to rotate concurrently in the opposite direction. As shown in the drawings, the fabric 60 knitted by the circular knitting machine is wound between the main fabric spreading roller 41 and the first driven roller 42 to another side of the main fabric spreading roller 41 and winding out from the second driven roller 43. The fabric 60 wound on the fabric spreading roller set 40 is flattened and winds out from the right hand side thereof. The fabric 60 winding out from the fabric spreading roller set 40 further winds on the first fabric extending bar 54 hinged on the fabric folding rails 51 below the fabric spreading roller set 40 and winds out at the lower side to the left side direction. The fabric 60 winding out from the first extending bar 54 winds again on the tension balance moving bar 53 straddled the tracks 514 and winds out at the lower side to the right direction so that the first fabric extending bar 54 and the tension balance moving bar 53 are spaced from each other at a distance of a first zone fabric length X1. The fabric 60 winding out from the tension balance moving bar 53 further winds on the second fabric extending bar 55 hinged on the fabric folding rails 51 at the right side of the tension balance moving bar 53 and winds out at the lower side in the left direction so that the tension balance moving bar 53 and the second fabric extending bar 55 are spaced from each other to form a second zone fabric length X2. The fabric 60 winding out from the second fabric extending bar 55 further winds on the fabric level moving and lowering means 52 which moves reciprocally and horizontally on the tracks 514. As the fabric level moving and lowering means 52 has the forward turning fabric folding bar 521 and reverse turning fabric folding bar 522 hinged horizontally thereon and equipped with spinning power, the fabric 60 winding out from the second fabric extending bar 55 winds between the forward turning fabric folding bar 521 and reverse turning fabric folding bar 522 and is lowered beneath between the forward and reverse turning fabric folding bars 521 and 522 at an amount same as continuously knitted by the circular knitting machine, and the second fabric extending bar 55 and the interval of the forward and reverse turning fabric folding bars 521 and 522 are spaced to form a third zone fabric length X3. The fabric held in the buffer transient storing apparatus 50 has a total length X which is the sum of the first zone fabric length X1 and the second zone fabric length X2 and the third zone fabric length X3, namely, X=X1+X2+X3. In addition, the fabric level moving and lower means 52 has a second chain holding spot 527. The chain 70 has one end fastened to the second chain holding spot 527 and another end winding leftwards on the chain turning axle 512 hinged on the outer side of the track 514 and winding out from the upper side in the right direction. The second chain holding spot 527 and the chain turning axle 512 are spaced from each other to form a third zone chain length Y3. The chain 70 winding out from the chain turning axle 512 winds on a side end of the tension balance moving bar 53 and winds out from the upper side in the left direction. The chain turning axle 512 and the tension balance moving bar 53 are spaced from each other to form a second china zone length Y2. The chain 70 winding out from the tension balance moving bar 514 winds on the first chain holding spot 511 fastened to the track 514 to be anchored. The tension balance moving bar 53 and the first chain holding spot 511 are spaced from each other to form a first zone chain length Y1. The chain has a total length Y equal to the sum of the first zone chain length Y1 and the second zone chain length Y2 and the third zone chain length Y3, namely, Y=Y1+Y2+Y3. Referring to FIG. 5A, when the circular knitting machine continuously knits and lowers the fabric 60, the fabric level moving and lowering means 52 starts moving horizontally rightwards. As the fabric level moving and lowering means 52 drives the tension balance moving bar 53 horizontally on the tracks 514 through the chain 70, the tension balance moving bar 53 starts moving leftwards. Referring to FIG. 5B, while the fabric level moving and lowering means 52 moves horizontally rightwards, the forward and reverse turning fabric folding bars 521 and 522 lower the fabric through the gear rack 513 at an amount same as the knitted and unloaded fabric of the circular knitting machine. Hence the length of the fabric continuously knitted and unloaded by the circular knitting machine is equal to the horizontal moving distance of the fabric level moving and lowering means 52, namely same as the length of the fabric lowering amount from the forward and reverse turning fabric folding bars 521 and 522. For example, given L1 for the fabric unloading length knitted continuously by the circular knitting machine as shown from FIG. 5A to FIG. 5B, the rightward horizontal moving distance of the fabric level moving and lowering means 52 from FIG. 5A to FIG. 5B also is L1. Due to the forward and reverse turning fabric folding bars 521 and 522 are engaged with the gear rack 513, the fabric lowering amount of the level moving and lowering means 52 also is equal to L1. The fabric length L1 unloaded by the circular knitting machine is equal to the fabric lowering length L1 from between the forward and reverse turning fabric folding bars 521 and 522 that is laid flatly on the fabric loading board 23. The level moving and lowering means 52 moves horizontally rightwards at the distance L1, meanwhile the tension balance moving bar 53 of the buffer transient storing apparatus 50 moves concurrently and horizontally leftwards, as a result, the first zone fabric length X1 increases one half of L1 (namely L1/2), plus the second zone fabric length X2 adding one half of L1 (namely L1/2) to be absorbed and held temporarily. Namely, when the fabric level moving and lowering means 52 moves horizontally rightwards between the second fabric extending bar 55 and the chain turning axle 512, the third zone fabric length X3 reduces the fabric length L1 equal to the increased fabric length L1/2 of the first zone fabric length X1 plus the increased fabric length L1/2 of the second zone fabric length X2. The increased fabric length L1/2 of the first zone fabric length X1 also is equal to the increased length L1/2 of the second zone fabric length X2. The third zone fabric length X3 reduces the length L1 equal to the increased length L1 of the third zone chain length L1, and also equals to the reduced length L1/2 of the first zone chain length Y1 plus the reduced length L1/2 of the second zone chain length Y2. When the circular knitting machine continuously knits and unloads the fabric at a length L2 as shown from FIG. 5B to FIG. 5C, the fabric level moving and lowering means 52 also moves rightwards horizontal at the distance L2 as shown from FIG. 5B to FIG. 5C. Due to the forward and reverse turning fabric folding bars 521 and 522 are engaged with the gear rack 513, the fabric lowering amount of the level moving and lowering means 52 also is equal to L2. The fabric length L2 unloaded by the circular knitting machine is equal to the fabric lowering length L2 from between the forward and reverse turning fabric folding bars 521 and 522 that is laid flatly on the fabric loading board 23. The level moving and lowering means 52 moves horizontally rightwards at the distance L2, meanwhile the tension balance moving bar 53 of the buffer transient storing apparatus 50 moves concurrently and horizontally leftwards, as a result, the first zone fabric length X1 increases one half of L2 (namely L2/2), plus the second zone fabric length X2 also adding one half of L2 (namely L2/2) to be absorbed and held temporarily. Namely, when the fabric level moving and lowering means 52 moves horizontally rightwards between the second fabric extending bar 55 and the chain turning axle 512, the third zone fabric length X3 reduces fabric length L2 equal to the increased fabric length L2/2 of the first zone fabric length X1 plus the increased fabric length L2/2 of the second zone fabric length X2. The increased fabric length L2/2 of the first zone fabric length X1 is equal to the increased length L2/2 of the second zone fabric length X2, and the reduced fabric length L2 of the third zone fabric length X3 is equal to the increased length L2 of the third zone chain length Y3, and also equals to the reduced length L2/2 of the first zone chain length Y1 plus the reduced length L2/2 of the second zone chain length Y2. When the circular knitting machine continuously knits and unloads the fabric at a length L3 as shown from FIG. 5C to FIG. 5D, the fabric level moving and lowering means 52 also moves rightwards horizontal at the distance L3. Due to the forward and reverse turning fabric folding bars 521 and 522 are engaged with the gear rack 513, the fabric lowering amount of the level moving and lowering means 52 also is equal to L3. The fabric length L3 unloaded by the circular knitting machine is equal to the fabric lowering length L3 from between the forward and reverse turning fabric folding bars 521 and 522 that is laid flatly on the fabric loading board 23, and overlapped with the length L2 shown in FIG. 5C. The level moving and lowering means 52 moves horizontally leftwards at the distance L3, meanwhile the tension balance moving bar 53 of the buffer transient storing apparatus 50 moves concurrently and horizontally rightwards, as a result, the first zone fabric length X1 reduces one half of L3 (namely L3/2), and the second zone fabric length X2 also reduces one half of L3 (namely L3/2) that are replenished by the fabric 60 held in the buffer transient storing apparatus 50. Namely, when the fabric level moving and lowering means 52 moves horizontally rightwards between the second fabric extending bar 55 and the chain turning axle 512, the fabric increasing length L3 of the third zone fabric length X3 is equal to the reduced fabric length L3/2 of the first zone fabric length X1 plus the reduced fabric length L3/2 of the second zone fabric length X2. The reduced fabric length L3/2 of the first zone fabric length X1 is equal to the reduced length L3/2 of the second zone fabric length X2, and the increased length L3 of the third zone fabric length X3 is equal to the reduced length L3 of the third zone chain length Y3, and also equals to the increased length L3/2 of the first zone chain length Y1 plus the increased length L3/2 of the second zone chain length Y2. Thus while the level moving and lowering means 52 moves continuously reciprocally and horizontally the fabric 60 held in the buffer transient storing apparatus 50 above maintains a constant tension without sagging or impact the moving path of the level moving and lowering means 52. The level moving and lowering means 52 also can lower the fabric at an amount same as the unloading fabric continuously knitted by the circular knitting machine, and the fabric is folded and stacked onto the fabric loading board 23.

Figure 7:
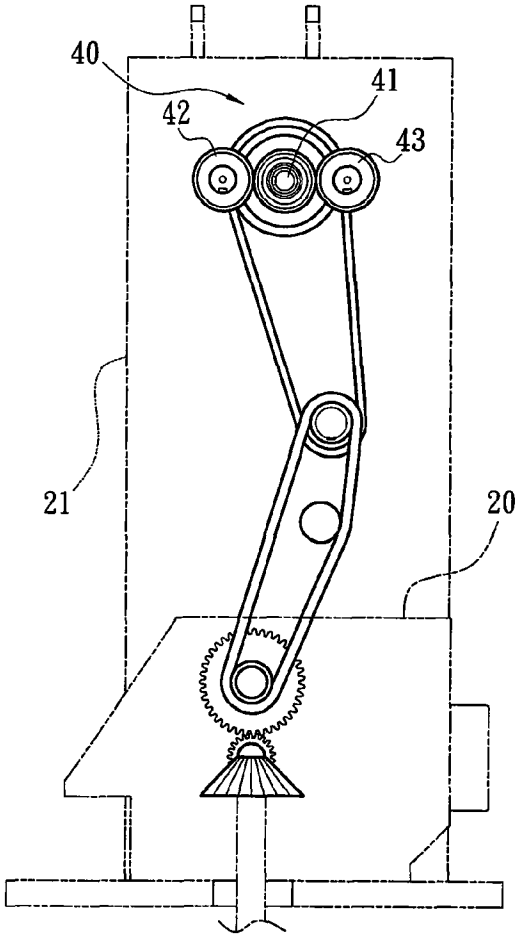
FIG. 7 is a fragmentary plane view of the fabric spreading roller set of the invention in a transmission link condition.
Figure 9C:
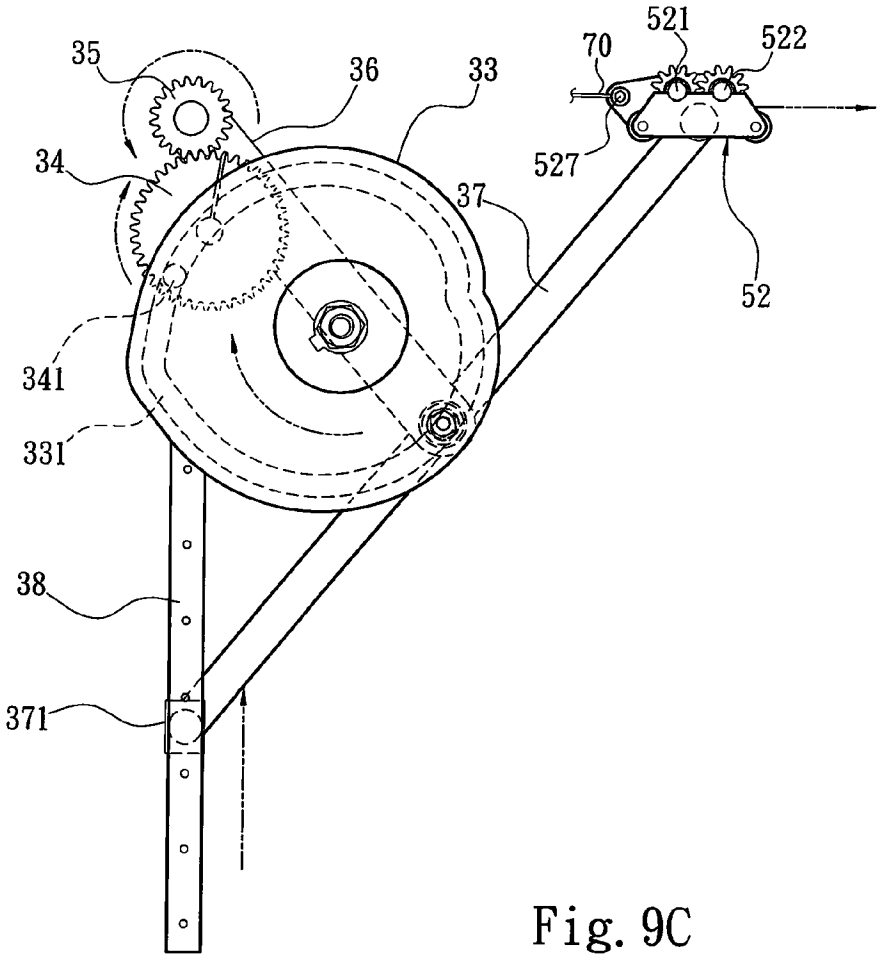
Figure 9D:
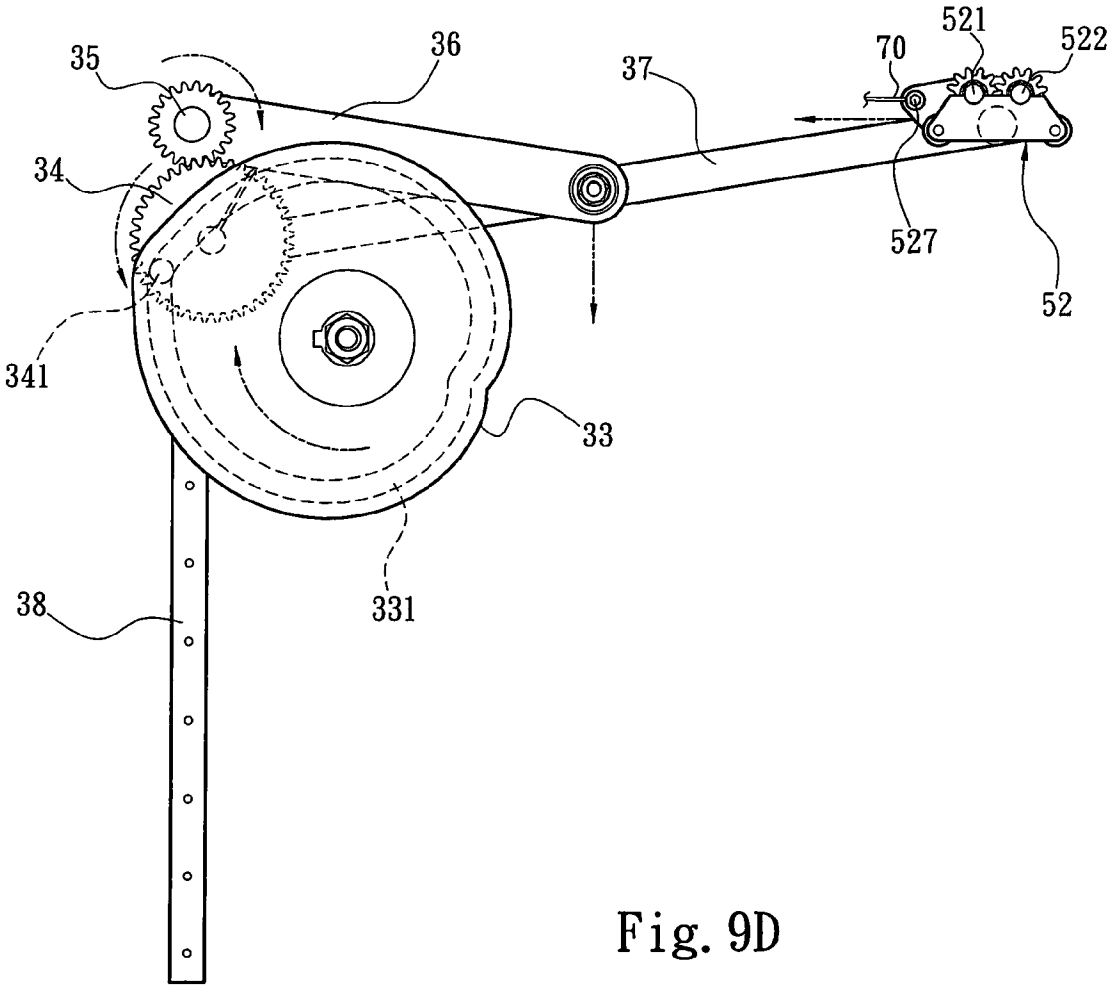
Figure 9E:
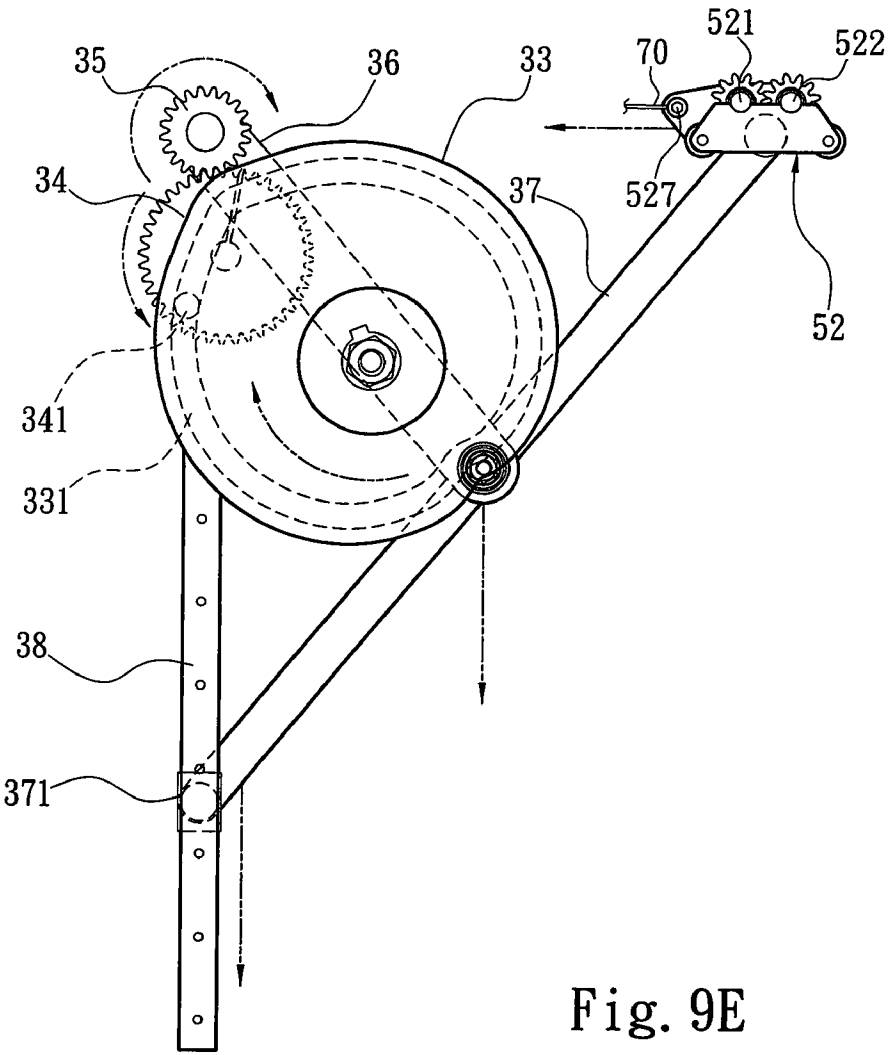

Referring to FIG. 7, the fabric spreading roller set 40 includes a main fabric spreading roller 41, a first driven roller 42 at one side of the main fabric spreading roller 41 to rotate concurrently in the opposite direction and a second driven roller 43 at another side of the main fabric spreading roller 41 to rotate concurrently in the opposite direction. The variable direction and variable speed wheel box 20 transmits motion to the main fabric spreading roller 41 through the first side board 21 to continuously generate spinning power counterclockwise. Refer to FIGS. 8 and 9A through 9E for driving means 30 of the invention in a transmission link and consecutive operating conditions. As shown in FIG. 8, the driving means 30 has a cam driving wheel 31 hinged on the second side board 22 engaged with the main fabric spreading roller 41 to be driven to rotate concurrently clockwise. The cam driving wheel 31 rotating clockwise drives the cam driven wheel 32 at the lower side to rotate clockwise concurrently. Due to the cam driven wheel 32 is fastened to a cam 33, they rotate concurrently clockwise. Referring to FIG. 9A, the cam 33 has a cam track 331 consisting of two symmetrical indented arched paths. The second side board 22 has an actuation wheel 34 hinged on the outer side thereof that has a jutting actuation member 341 held in the cam track 331. When the cam 33 rotates continuously clockwise the actuation member 341 is directed by the cam track 331 to turn clockwise, meanwhile the transmission wheel 35 hinged on the outer side of the second side board 22 is driven by the actuation wheel 34 to turn counterclockwise. The oscillation arm 36 fastened to the transmission wheel 35 oscillates clockwise as shown in FIG. 9B, and the oscillation arm 36 has a triple-axis lever 37 hinged thereon that has one end hinged on the fabric level moving and lowering means 52 to move it horizontally rightwards and another end fastened to a slider 371 to slide up and down on the sliding track 38 formed on an inner side of the second side board 22. Meanwhile, the cam 33 rotates continuously clockwise, and the actuation member 341 also is directed by the cam track 331 so that the actuation wheel 34 continuously turns clockwise, and the transmission wheel 35 is driven by the actuation wheel 34 to turn continuously counterclockwise. The oscillation arm 36 also oscillates continuously counterclockwise as shown in FIG. 9C. The fabric level moving and lowering means 52 hinged on one end of the tripe-axis lever 37 also continuously moves horizontally rightwards. When the oscillation arm 36 oscillates to move the fabric level moving and lowering means 52 beyond the slide track 38, the slider 371 at another end of the triple-axis lever 37 starts sliding upwards on the slide track 38, meanwhile the cam 33 continuously turns clockwise, and the actuation member 341 is directed by the cam track 331 to make the actuation wheel 34 to turn continuously clockwise. When the cam 33 continuously turns clockwise, the actuation member 341 is directed by the cam track 331 to arrive the junction of the two indented arched paths as shown in FIG. 9D. The actuation wheel 34 starts turning counterclockwise, and the transmission wheel 35 also is driven by the actuation wheel 34 to start turning clockwise, and the oscillation arm 36 also oscillates clockwise as shown in FIG. 9E. The fabric level moving and lowering means 52 hinged on the one end of triple-axis lever 37 starts moving horizontally leftwards, and the slider 371 at another end of the triple-axis lever 37 starts sliding downwards on the slide track 38. Thus the cam 33 turns continuously clockwise and the oscillation arm 36 also oscillates in a non-stop cycle as shown in FIGS. 9A through 9E. The fabric level moving and lowering means 52 also is driven to move constantly in a reciprocal and horizontal fashion, and the slider 371 slides constantly up and down on the slide track 38. As a result, the fabric level moving and lowering means 52 can be moved reciprocally and horizontally.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method for lowering and folding fabric at an amount same as knitted and unloaded by a circular knitting machine, comprising:

providing a fabric spreading roller set which is horizontally located in the circular knitting machine and below the fabric continuously knitted by the circular knitting machine to rotate synchronously with a needle cylinder of the circular knitting machine in a same direction and has spinning power to lower the fabric;

winding the fabric continuously knitted by the circular knitting machine on the fabric spreading roller set to flatten and wind out the fabric at one side;

providing two fabric folding rails which are horizontally located below the two ends of the fabric spreading roller set and perpendicular to the fabric spreading roller set and have respectively a horizontal track located thereon;

providing a first fabric extending bar at the one side where the fabric winds out from the fabric spreading roller set, the first fabric extending bar being hinged on an outer side of the track of the fabric folding rail in a straddle manner and parallel with the fabric spreading roller set;

winding the fabric wound out from the fabric spreading roller set on the first fabric extending bar and winding out the fabric at a lower side opposite to the winding direction;

providing a tension balance moving bar on the track in a straddle manner at the side where the first fabric extending bar winds out the fabric, the tension balance moving bar being parallel with the fabric spreading roller set and movable reciprocally and horizontally on the track;

winding the fabric wound out from the first fabric extending bar on the tension balance moving bar at a lower side opposite to the winding direction and spacing the first fabric extending bar from the tension balance moving bar to form a first zone fabric length therebetween;

providing a first chain holding spot on another outer side of the track and at the same side where the first fabric extending bar winds out the fabric;

providing a chain which has one end fastened to the first chain holding spot and another end winding on a side end of the tension balance moving bar and winding out at a lower side opposite to the winding direction and spacing the first chain holding spot from the tension balance moving bar to form a first zone chain length therebetween;

providing a second fabric extending bar at the fabric winding out side of the tension balance moving bar that is hinged on the outer side of the track of the fabric folding rail in a straddle manner and parallel with fabric spreading roller set;

winding the fabric wound out from the tension balance moving bar on the second fabric extending bar and winding out at a lower side opposite to the winding direction, and spacing the tension balance moving bar from the second fabric extending bar to form a second zone fabric length therebetween;

providing a chain turning axle at the chain winding out side of the tension balance moving bar that is hinged on the outer side of the track of the fabric folding rail;

winding the chain wound out from the tension balance moving bar on the chain turning axle at a lower side opposite to the winding direction, and spacing the tension balance moving bar from the chain turning axle to form a second zone chain length therebetween;

providing a fabric level moving and lowering means on the track that is movable reciprocally and horizontally and has a forward turning fabric folding bar and a reverse turning fabric folding bar hinged thereon in a parallel and straddle manner to provide spinning power and movable reciprocally and horizontally on the fabric folding rails between the second fabric extending bar and the chain turning axle in parallel with the fabric spreading roller set;

winding the fabric wound out from the second fabric extending bar between the forward turning fabric folding bar and the reverse turning fabric folding bar, and lowering the fabric therebetween at an amount same as the fabric continuously knitted and unloaded by the circular knitting machine to space the second fabric extending bar from the interval of forward turning fabric folding bar and the reverse turning fabric folding bar to form a third zone fabric length therebetween;

providing a second chain holding spot on the fabric level moving and lowering means;

fastening the chain wound out from the chain turning axle to the second chain holding spot to space the chain turning axle from the second chain holding spot to form a third zone chain length therebetween;

providing a fabric loading board which is located horizontally in the circular knitting machine below the fabric level moving and lowering means and having a width at least same as the width of the fabric and a length at least same as the distance of the reciprocal movement of the forward turning fabric folding bar and the reverse turning fabric folding bar while the fabric level moving and lowering means moves reciprocally and horizontally, the loading board being parallel with the fabric spreading roller set and rotating synchronously therewith in the same direction; and moving the fabric level moving and lowering means reciprocally and horizontally between the second fabric extending bar and the chain turning axle while the fabric is lowered between the forward and reverse turning fabric folding bars at the same amount continuously knitted and unloaded by the circular knitting machine, the fabric of the third zone fabric length decreasing at an amount equal to the sum of the fabric increased amounts of the first zone fabric length and the second zone fabric length, and the fabric increased amount of the first zone fabric length being equal to the fabric increased amount of the second zone fabric length, and the fabric of the third zone fabric length also decreasing at another amount being equal to an increased amount of the third zone chain length and also equal to the sum of an decreased amount of the first zone chain length and another decreased amount of the second zone chain length; the fabric of the third zone fabric length also increasing at an amount equal to the sum of a fabric decreased amount of the first zone fabric length and another fabric decreased amount of the second zone fabric length, and the fabric decreased amount of the first zone fabric length being equal to the fabric decreased amount of the second zone fabric length, and the fabric increased amount of the third zone fabric length being equal to a decreased amount of the third zone chain length and also equal to the sum of an increased amount of the first zone chain length and another increased amount of the second zone chain length, such that the tension balance moving bar and the fabric level moving and lowering means are moved concurrently in a reciprocal and horizontal fashion between the tracks opposite to each other and the fabric located above is maintained at a constant tension while the fabric level moving and lowering means moves reciprocally and horizontally and is lowered at an equal amount to the fabric loading board and folded thereon.

2. The method of claim 1, wherein the fabric spreading roller set includes a main fabric spreading roller, a first driven roller at one side of the main fabric spreading roller to rotate synchronously in an opposite direction thereof and a second driven roller at another side of the main fabric spreading roller to rotate synchronously in the opposite direction thereof, the fabric continuously knitted by the circular knitting machine being wound between the main fabric spreading roller and the first driven roller or between the main fabric spreading roller and the second driven roller and being wound on another side of the main fabric spreading roller to the first driven roller or the second driven roller for winding out.

3. The method of claim 2 further including providing a gear rack fastened to the fabric folding rail at a length less than the distance between the second fabric extending bar and the chain turning axle, and also providing a first one-way gear and a forward turning gear both fastened to the two ends of the forward turning fabric folding bar, and providing a second one-way gear and a reverse turning gear both fastened to the two ends of the reverse turning fabric folding bar, the first one-way gear and the second one-way gear being located at a same side of the forward and reverse turning fabric folding bars to engage with the gear rack at the same side, the forward turning gear and the reverse turning gear being at another side engageable with each other, the first one-way gear or the second one-way gear being turned one-way while the fabric level moving and lowering means moves reciprocally and horizontally to synchronously drive the forward turning gear and the reverse turning gear to turn downwards at the engaged junction to provide the spinning power on the forward and reverse turning fabric folding bars to lower the fabric.

4. The method of claim 3 further having a variable direction and variable speed wheel box in the circular knitting machine fastened to a lower side of the fabric loading board to rotate synchronously therewith in the same direction, the variable direction and variable speed wheel box being driven by power generated by rotation of the needle cylinder to provide the spinning power transmitted to the fabric spreading roller set to lower the fabric and provide power for the fabric level moving and lowering means to move reciprocally and horizontally.

5. A buffer transient storing apparatus for forming a transmission link with the variable direction and variable speed wheel box in the circular knitting machine driven by the spinning power of the needle cylinder, the variable direction and variable speed wheel box having two ends extended upwards to pivotally couple with the fabric spreading roller set and provide spinning power to the fabric spreading roller set to rotate synchronously with the needle cylinder in the same direction, the fabric spreading roller set being located horizontally located in the circular knitting machine and below the fabric knitted by the circular knitting machine, the variable direction and variable speed wheel box being fastened to a fabric loading board, the buffer transient storing apparatus including:

two corresponding fabric folding rails which are fastened to a lower side of two ends of the fabric spreading roller set hinged on an upward extension of the variable direction and variable speed wheel box and located horizontally above the fabric loading board, the fabric folding rails being perpendicular to the fabric spreading roller set and having respectively a horizontal track corresponding to each other;

a first fabric extending bar which is parallel with the fabric spreading roller set and has two ends respectively hinged on an outer side of the tracks;

a tension balance moving bar which is movable reciprocally and horizontally on the tracks in parallel with the fabric spreading roller set and has two ends straddling the tracks;

a second fabric extending bar which is parallel with the fabric spreading roller set and has two ends hinged on the outer side of the tracks same as the first fabric extending bar;

two first chain holding spots fastened respectively to another outer side of the tracks;

two chain turning axles hinged respectively on the another outer side of the tracks same as the first chain holding spots;

two fabric level moving and lowering means which are located on the fabric folding rails and movable reciprocally and horizontally between the second fabric extending bar and the chain turning axle and have a forward turning fabric folding bar and a reverse turning fabric folding bar hinged thereon horizontally equipped with spinning power that are parallel with each other and with the fabric spreading roller set, and also have respectively a second chain holding spot located thereon, and two chains which respectively have one end fastened to the first chain holding spot and another end winding a side end of the tension balance moving bar and winding reversely on the chain turning axle and turned reverse again to fasten to the second chain holding spot.

6. The buffer transient storing apparatus of claim 5, wherein the fabric spreading roller set includes a main fabric spreading roller, a first driven roller at one side of the main fabric spreading roller to rotate synchronously in an opposite direction thereof and a second driven roller at another side of the main fabric spreading roller to rotate synchronously in the opposite direction thereof.

7. The buffer transient storing apparatus of claim 6, wherein the two fabric folding rails have respectively a gear rack fastened to the track at a length less than the distance between the second fabric extending bar and the chain turning axle, the forward turning fabric folding bar having two ends fastened respectively to a first one-way gear and a forward turning gear, the reverse turning fabric folding bar having two ends fastened respectively to a second one-way gear and a reverse turning gear, the first one-way gear and the second one-way gear being located at a same side of the forward and reverse turning fabric folding bars to engage with the gear rack at the same side, the forward turning gear and the reverse turning gear being at another same side engageable with each other.

8. The buffer transient storing apparatus of claim 7, wherein the fabric level moving and lower means forms a transmission link with the variable direction and variable speed wheel box.

9. A full-width fabric folding machine, comprising:

a variable direction and variable speed wheel box which is driven by the spinning power of the needle cylinder of the circular knitting machine through a transmission link and located at the bottom of the circular knitting machine to rotate synchronously with the needle cylinder in the same direction, the variable direction and variable speed wheel box having two ends extending upwards a first side board and a second side board, the first side board and the second side board being bridged by a fabric loading board;

a fabric spreading roller set which is hinged horizontally on the first side board and the second side board and located below the fabric knitted by the circular knitting machine and above the fabric loading board to form another transmission link with the variable direction and variable speed wheel box;

a driving means hinged on the second side board to link for transmission with the fabric spreading roller set; and a buffer transient storing apparatus which is located between the fabric spreading roller set and the fabric loading board and has two fabric folding rails fastened respectively to the first side board and the second side board, the driving means forming a transmission link with the fabric level moving and lowering means on the second side board.

10. The full-width fabric folding machine of claim 9, wherein the fabric spreading roller set includes a main fabric spreading roller forming a transmission link with the variable direction and variable speed wheel box, a first driven roller at one side of the main fabric spreading roller to rotate synchronously in an opposite direction thereof and a second driven roller at another side of the main fabric spreading roller to rotate synchronously in the opposite direction thereof.

11. The full-width fabric folding machine of claim 10, wherein the driving means includes:

a cam driving wheel hinged on an outer side of the second side board and engaged with the fabric spreading roller set to rotate synchronously through a transmission link, a cam driven wheel hinged on the outer side of the second side board to form a transmission link with the cam driving wheel to rotate synchronously in the same direction;

a cam which is hinged on the outer side of the second side board and fastened to the cam driven wheel to rotate synchronously in the same direction and has a cam track formed thereon;

an actuation wheel which is hinged on the outer side of the second side board and has an actuation member fastened thereon and directed by the cam track to oscillate the actuation wheel;

a transmission wheel hinged on the outer side of the second side board to form another transmission link with the actuation wheel to oscillate synchronously in an opposite direction;

an oscillation arm which oscillates synchronously with the transmission wheel in the same direction and has one end located on an inner side of the second side board to fasten to the transmission wheel;

a triple-axis lever which is hinged on another end of the oscillation arm and has one end hinged on the fabric level moving and lowering means and another end hinged on a slider at the inner side of the second side board; and a slide track perpendicular to the inner side of the second side board to allow the slider to slide on a straight line.

12. The full-width fabric folding machine of claim 11, wherein the cam driving wheel and the cam driven wheel are connected through a linking chain.

13. The full-width fabric folding machine of claim 12, wherein the cam track includes two symmetrical and indented arched paths.

14. The full-width fabric folding machine of claim 13, wherein actuation member is protrusive and held in the cam track.

15. The full-width fabric folding machine of claim 14, wherein transmission wheel transmits motion synchronously to a transmission shaft in a same direction, the transmission shaft forming a transmission link with the fabric level moving and lowering means located on the fabric folding rails on the first side board.

16. The full-width fabric folding machine of claim 15, wherein the transmission wheel and the transmission shaft are linked through a transmission linking chain.

* * * * *